US010995650B2

(12) United States Patent
Cox et al.

(10) Patent No.: US 10,995,650 B2
(45) Date of Patent: May 4, 2021

(54) HEAT SHIELD FOR BELLOWS

(71) Applicant: CUMMINS INC., Columbus, IN (US)

(72) Inventors: Stephen Cox, Columbus, IN (US); Thomas R. Shuttleworth, Columbus, IN (US)

(73) Assignee: Cummins Inc., Columbus, IN (US)

( * ) Notice: Subject to any disclaimer, the term of this patent is extended or adjusted under 35 U.S.C. 154(b) by 478 days.

(21) Appl. No.: 15/889,758

(22) Filed: Feb. 6, 2018

(65) Prior Publication Data

US 2018/0252141 A1 Sep. 6, 2018

Related U.S. Application Data

(60) Provisional application No. 62/466,633, filed on Mar. 3, 2017.

(51) Int. Cl.
*F16L 27/10* (2006.01)
*F01N 13/14* (2010.01)
*F01N 13/18* (2010.01)

(52) U.S. Cl.
CPC ..... *F01N 13/14* (2013.01); *F01N 13/1816* (2013.01)

(58) Field of Classification Search
CPC ..... F16L 55/0337; F16L 59/153; F16L 27/10; F16L 27/1004; F16L 27/11; F01N 13/14; F01N 13/1816
USPC ..... 285/47, 48, 49, 50
See application file for complete search history.

(56) References Cited

U.S. PATENT DOCUMENTS 5,145,215 A * 9/1992 Udell ..... F01N 13/1816 285/226
6,047,993 A * 4/2000 Jungbauer ..... F01N 13/1816 285/226
6,354,632 B1 * 3/2002 Jung ..... F01N 13/1811 285/49
6,902,203 B2 * 6/2005 Kang ..... F01N 13/1811 285/226
7,748,749 B2 * 7/2010 Baumhoff ..... F01N 13/1816 285/49
9,046,199 B2 6/2015 Gartner et al.
9,261,216 B2 2/2016 Stalcup et al.
2006/0197340 A1 * 9/2006 Senoo ..... F16L 27/11 285/226

(Continued)

FOREIGN PATENT DOCUMENTS

KR 20130006455 11/2013

*Primary Examiner* — Aaron M Dunwoody
(74) *Attorney, Agent, or Firm* — Foley & Lardner LLP

(57) ABSTRACT

A heat shield for a bellows includes a central section, a first outer section, a first annular insert, a first annular flexion member, a first pipe, and a first rod. The first outer section includes a first outer section first end and a first outer section second end opposite the first outer section end. The first annular insert includes a first slot and is positioned within the first outer section second end. The first annular flexion member is coupled to the first outer section first end of the first outer section and coupled to the central section. The first annular flexion member facilitates movement between the first outer section and the central section. The first pipe is partially received within the first slot in the first annular insert. Movement between the first outer section and the central section causes movement between the first pipe and the first rod.

24 Claims, 18 Drawing Sheets

(56) References Cited

U.S. PATENT DOCUMENTS

| | | | | |
|---|---|---|---|---|
| 2012/0318371 | A1* | 12/2012 | Rynders, Jr. | F16L 51/027 137/15.01 |
| 2015/0013948 | A1* | 1/2015 | Barnes | F02M 26/11 165/135 |
| 2015/0121715 | A1* | 5/2015 | Houser | D06F 58/20 34/235 |
| 2016/0290212 | A1* | 10/2016 | Sarsfield | F01N 13/1855 |
| 2018/0038530 | A1* | 2/2018 | Yeandel | F16L 51/027 |
| 2018/0087434 | A1* | 3/2018 | Gidla | F01N 13/1816 |

* cited by examiner

DETAIL A

HEAT SHIELD FOR BELLOWS

CROSS-REFERENCE TO RELATED APPLICATION

This application claims the benefit of and priority to U.S. Provisional Patent Application No. 62/466,633, filed on Mar. 3, 2017, the contents of which are incorporated herein by reference in their entirety.

TECHNICAL FIELD

The present disclosure relates generally to the field of exhaust systems, such as exhaust systems for internal combustion engines.

BACKGROUND

Exhaust systems for internal combustion engines include exhaust manifolds connected to cylinder heads of the engine. The exhaust manifolds collect post-combustion material (e.g., exhaust gas) from multiple cylinders of the engine and deliver the material to an exhaust pipe. In operation, exhaust manifolds are subject to highly variable temperatures. Temperature variations cause the exhaust manifolds to expand and contract, which may stress and ultimately damage the manifolds, seals, and other components. Thermal expansion may be particularly problematic for large engines with correspondingly long exhaust manifolds. To that end, exhaust systems for some engines utilize exhaust manifolds that are separated into several sections. The sections are coupled together using flexible couplings, such as bellows, that permit expansion and contraction between the sections. These bellows may be subject to high amounts of heat. Accordingly, it is often desired to insulate the bellows. However, conventional insulation mechanisms are undesirable because they are either adhered to the bellows, and therefore not removable, or span across the bellows, and therefore be prone to increased wearing.

SUMMARY

In an embodiment, a heat shield for a bellows includes a central section, a first outer section, a first annular insert, a first annular flexion member, a first pipe, and a first rod. The first outer section adjoins the central section. The first outer section includes a first outer section first end and a first outer section second end opposite the first outer section first end. The first annular insert is positioned within the first outer section second end of the first outer section. The first annular insert includes a first slot. The first annular flexion member is coupled to the first outer section first end of the first outer section and coupled to the central section. The first annular flexion member facilitates movement between the first outer section and the central section. The first pipe is partially received within the first slot in the first annular insert. The first pipe has a first length. The first rod is slidably received within the first pipe. The first rod has a second length greater than the first length. Movement between the first outer section and the central section causes movement between the first pipe and the first rod.

In another embodiment, an exhaust system includes a first component, a second component, a bellows, and a heat shield. The second component receives exhaust gasses from the first component. The bellows is coupled to the first component and the second component. The bellows provides fluid communication between the first component and the second component. The bellows is configured to facilitate relative movement between the first component and the second component. The heat shield is coupled to the first component and the second component. The heat shield is configured to cover the bellows. The heat shield includes a first outer section, a second outer section, a central section, a first annular flexion member, and a second annular flexion member. The first outer section is coupled to the first component. The second outer section is coupled to the second component. The first annular flexion member is coupled to the central section and the first outer section. The second annular flexion member is coupled to the central section and the second outer section. Movement between the first component and the second component causes corresponding movement of the bellows and the heat shield such that the bellows remains covered by the heat shield during the movement.

In yet another embodiment, a heat shield for a bellows includes a central section. The heat shield also includes a first outer section that is coupled to a first fixture. The heat shield also includes a first annular flexion member. The first annular flexion member is coupled to the central section and the first outer section. The first annular flexion member is configured to facilitate movement of the first outer section relative to the central section. The heat shield also includes a first means for facilitating axial translation of the central section relative to the first fixture such that axial translation of the central section causes movement of the first outer section relative to the first fixture.

DETAILED DESCRIPTION

Figure 1A:
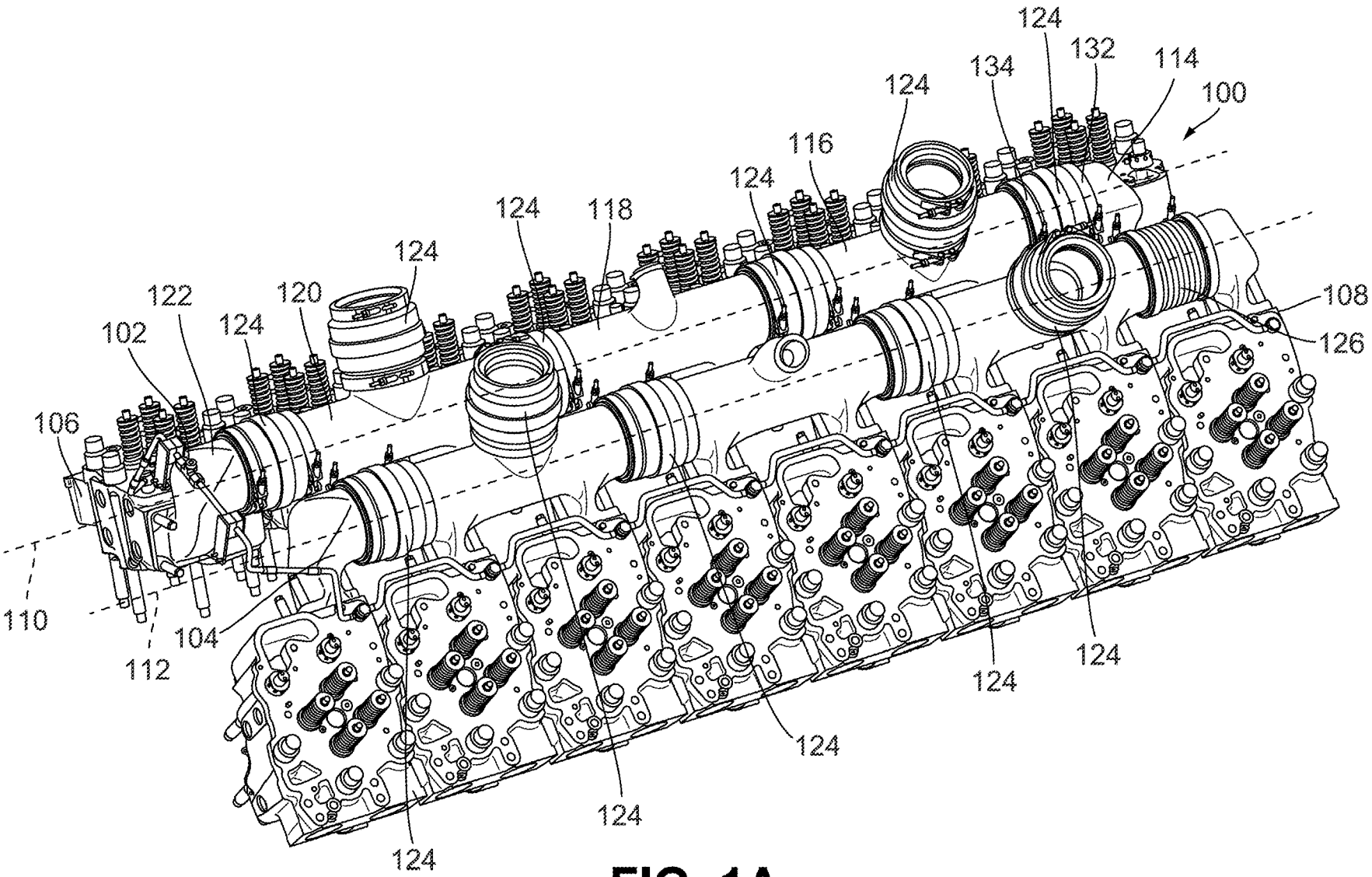
FIG. 1A is a perspective view of a portion of an exhaust system including a number of heat shields, according to an embodiment.

FIG. 1A is a perspective view of a portion of an exhaust system 100, according to an embodiment. As illustrated in FIG. 1A, the exhaust system 100 includes first manifold assembly 102 and a second manifold assembly 104 operably coupled to, and in exhaust gas communication with, a respective first cylinder head 106 and a second cylinder head 108 of an internal combustion engine. The first manifold assembly 102 and the second manifold assembly 104 are configured to convey exhaust gas from the respective first cylinder head 106 and the second cylinder head 108 of the engine. The exhaust gas may be conveyed from the first manifold assembly 102 and the second manifold assembly 104 to various components (e.g., a turbocharger, an exhaust gas recirculation system, a waste heat recovery system, exhaust aftertreatment components, etc.) and eventually discharged into the atmosphere. According to various embodiments, the engine may be a compression ignition (e.g., diesel) or spark ignition (e.g., gasoline, compressed natural gas) engine, etc. As illustrated in FIG. 1A, the exhaust system 100 is arranged for use with a V-engine. However, the exhaust system 100 may be similarly used with engines having in-line or other cylinder configurations.

As illustrated in FIG. 1A, the first manifold assembly 102 and the second manifold assembly 104 extend generally along a first central axis 110 and a second central axis 112. The first central axis 110 and the second central axis 112 may be parallel or substantially parallel with a crankshaft of the engine (not shown). Each of the first manifold assembly 102 and the second manifold assembly 104 includes multiple manifold sections. For example, the first manifold assembly 102 includes a first manifold section 114, a second manifold section 116, a third manifold section 118, a fourth manifold section 120, and a fifth manifold section 122. Each of the first manifold section 114, the second manifold section 116, the third manifold section 118, the fourth manifold section 120, and the fifth manifold section 122 includes a body portion defining a fluid passage extending therethrough. The first manifold assembly 102 and the second manifold assembly 104 also include several bellows to fluidly couple each of the manifold sections within the first manifold assembly 102 or the second manifold assembly 104, respectively. Typically, the bellows are compressed between manifold sections, and gaskets (not shown) are installed between each manifold section/bellows interface to fluidly seal the interface. The bellows permit relative displacement, both axially and transversely, between manifold sections. For example, manifold sections may experience relative displacement therebetween due to thermal expansion, vibration, slight assembly misalignments, etc. The bellows permit such displacement, which could otherwise damage conventional, unitary exhaust manifolds.

As shown in FIG. 1A, the exhaust system 100 includes a plurality of heat shields 124. The heat shields 124 are located at junctions between adjacent manifold sections (e.g., a first manifold section 114, a second manifold section 116, a third manifold section 118, a fourth manifold section 120, and a fifth manifold section 122. Each of the heat shields 124 covers a bellows 126 which is located at a junction between adjacent manifold sections and fluidly connects adjacent manifold sections. In FIG. 1A, the bellows 126 is shown for illustrative purposes only. In application, the heat shields 124 substantially cover each of the bellows 126. Each of the heat shields 124 is coupled to a first component and a second component. The first component may be, for example, a manifold section (e.g., the first manifold section 114, etc.), and the second component may be, for example, an adjacent manifold section (e.g., the second manifold section 116, etc.). Alternatively, the first component and the second component to which the heat shield 124 is coupled may be various components (e.g., pipes, conduits, frames, brackets, heat exchangers, etc.) within the exhaust system or within another system associated with an internal combustion engine (e.g., a waste heat recovery system, an aftertreatment system, an oil system, a fuel system, a fuel additive system, and other similar systems). In some applications, one or both of the first component and the second component may be the bellows 126 such that the heat shield 124 is coupled directly to the bellows 126.

The heat shields 124 provide insulation to the bellows 126 from high temperatures. For example, a cylinder head of an internal combustion engine may be at a high temperature during operation of the internal combustion engine. In this example, the bellows 126 may be located near the cylinder head and the heat shield 124 covers the bellows 126 such that the bellows 126 is protected from the heat given off by the cylinder head. The heat shield 124 may be implemented to meet customer or regulatory requirements. In some embodiments, the heat shield 124 increases performance characteristics (e.g., efficiency, etc.) of an aftertreatment system. In these embodiments, the heat shield 124 allows an internal combustion engine to be more desirable than an internal combustion engine that does not utilize the heat shield 124 and therefore has an aftertreatment system with relatively lower performance characteristics.

The manifold sections, the bellows, and the heat shields may be removably coupled in various ways. For example, v-bands (e.g., Marman clamps, etc.) may be utilized to removably couple the manifold sections and bellows and to compress and retain gaskets therebetween. In other embodiments, flanges of the respective manifold sections, bellows 126, and heat shields 124 are bolted together. As illustrated in FIG. 1A, a first v-band clamp 132 removably couples the first manifold section 114 to a first end of the bellows 126 and a first end of the heat shield 124, and a second v-band clamp 134 removably couples a first end of the second manifold section 116 to a second end of the bellows 126 and a second end of the heat shield 124.

According to various embodiments, an exhaust manifold sealing face is provided for improved bellows installation. The manifold section includes a shoulder, or pilot, that extends axially outward from a sealing face of an annular flange of the manifold section. The shoulder is configured to act as a guide for the bellows flange to move on (e.g., slide) as it is being compressed and installed between manifold sections, thereby protecting the gasket from being damaged by the bellows. Although the embodiments described herein include sealing faces for exhaust manifolds, other embodiments include sealing faces of other fluid passages or pipe joints. For example, certain embodiments relate to sealing joints of exhaust pipes downstream of the manifold. In addition, some embodiments include flexible joints or couplings other than bellows.

Figure 1B:
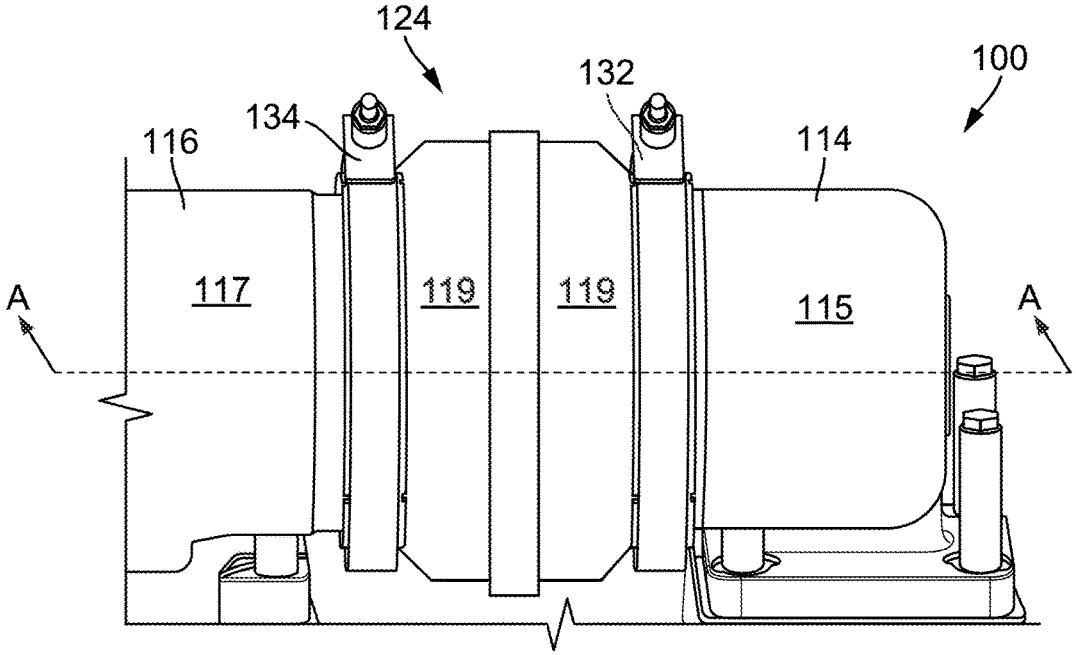
FIG. 1B is a partial side view of the exhaust system shown in FIG. 1A.

FIGS. 1B-7 illustrate the heat shield 124 in detail. FIG. 1B is a partial view of the exhaust system 100 of FIG. 1A, including the first manifold section 114 and the second manifold section 116, the bellows 126, and the first v-band clamp 132 and the second v-band clamp 134. The first manifold section 114 includes a first body portion 115. The first body portion 115 defines a first fluid passage (not shown) extending therethrough. Similarly, each of the second manifold section 116 and the heat shield 124 includes a second body portion 117 and a third body portion 119, respectively. The second body portion 117 and the third body portion 119 define a second fluid passage and a third fluid passage (not shown), respectively, extending therethrough.

Figure 1C:
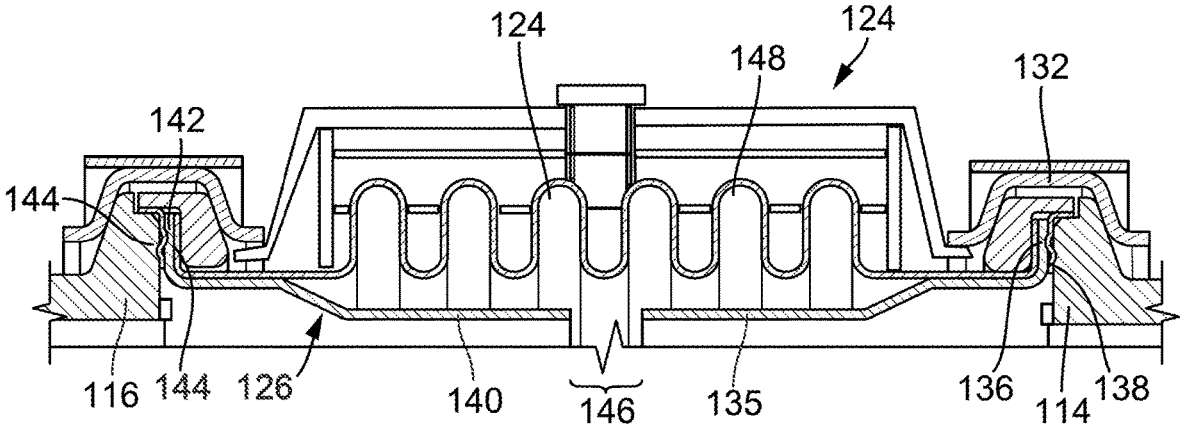
FIG. 1C is a partial cross-sectional view of the exhaust system shown in FIG. 1B, taken about line A-A.

FIG. 1C is a partial cross-sectional view of the exhaust system 100 of FIG. 1B, taken along line A-A. As shown in FIG. 1C, the bellows 126 fluidly couples the first manifold section 114 and the second manifold section 116. The first bellows 126 includes a first sleeve portion 135 that defines a first flange 136 extending radially outward from the first sleeve portion 135 at a bellows first end 138 of the bellows 126. The bellows 126 also includes a second sleeve portion 140 that similarly defines a second flange 142 extending radially outward from a bellows second end 144 of the bellows 126. The first sleeve portion 135 and the second sleeve portion 140 are separated by a gap 146. The first sleeve portion 135 and the second sleeve portion 140 may be formed of metal (e.g., steel or aluminum), polymer-based, or composite tubing bent or otherwise formed as illustrated in FIG. 1C. In some implementations, thermal requirements, for example, may drive material selection. Some embodiments similarly include couplings other than bellows.

The bellows 126 also includes a flexible member 148 coupling the first sleeve portion 135 and the second sleeve portion 140 and disposed on an outer periphery thereof. The flexible member 148 may be fixedly attached (e.g., bonded, adhered, etc.) to the outer periphery of each of the first sleeve portion 135 and the second sleeve portion 140. The flexible member 148 may be formed of rubber or other flexible materials. As illustrated in FIG. 1C, the flexible member 148 may include a wavy or convoluted surface that facilitates the flexibility of the flexible member 148. For example, the flexible member 148 of the bellows 126, as well as the gap 146 between the first sleeve portion 135 and the second sleeve portion 140, allows the bellows 126 to expand, contract, and otherwise move axially and transversely due to thermal expansion, vibration, misalignment, etc.

As shown in FIG. 1C, the heat shield 124 is configured such that the heat shield 124 does not contact the flexible member 148. In this way, convolutes of the flexible member 148 may move freely without contacting the heat shield 124. This may facilitate increased life of the heat shield 124 and/or the bellows 126 compared to conventional bellows and insulation mechanisms.

While the heat shield 124 has been described and shown as covering the bellows 126 between manifold sections, it is understood that the heat shield 124 may be similarly implemented to cover bellows in other locations in the exhaust system 100 or in other locations surrounding an internal combustion engine.

Figure 8A:
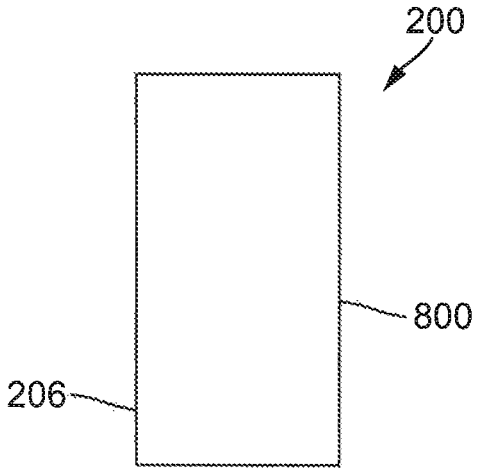
FIG. 8A is a top view of an outer section for a heat shield, according to an embodiment.

The heat shield includes two outer sections 200 and a central section 202. The outer sections 200 are shown in detail in FIGS. 8A and 8B, and the central section 202 is shown in detail in FIGS. 9A and 9B. Each of the outer sections 200 includes a central end 800 (i.e., a first end), shown in FIG. 8A, and a coupling end 206 (i.e., a second end). Each of the coupling ends 206 is configured to individually couple the respective outer section 200 to a fitting, such as a manifold section. The coupling ends 206 may be tapered inward from the respective outer section 200. In this way, the coupling ends 206 provide a seal with the corresponding fitting. Alternatively, the coupling end 206 may be identical to the central end 800 such that the outer section 200 is symmetrical.

The central end 800 of each of the outer sections 200 is covered by the central section 202. According to various embodiments, the central ends 800 of the outer sections 200 are defined by a first diameter and the central section 202 is defined by a second diameter greater than the first diameter. In this way, the central section 202 may cover (e.g., overlap, etc.) a portion of each of the outer sections 200. According to various embodiments, the central section 202 has a first length, and the outer sections 200 each have a second length greater than the first length.

Figure 8B:
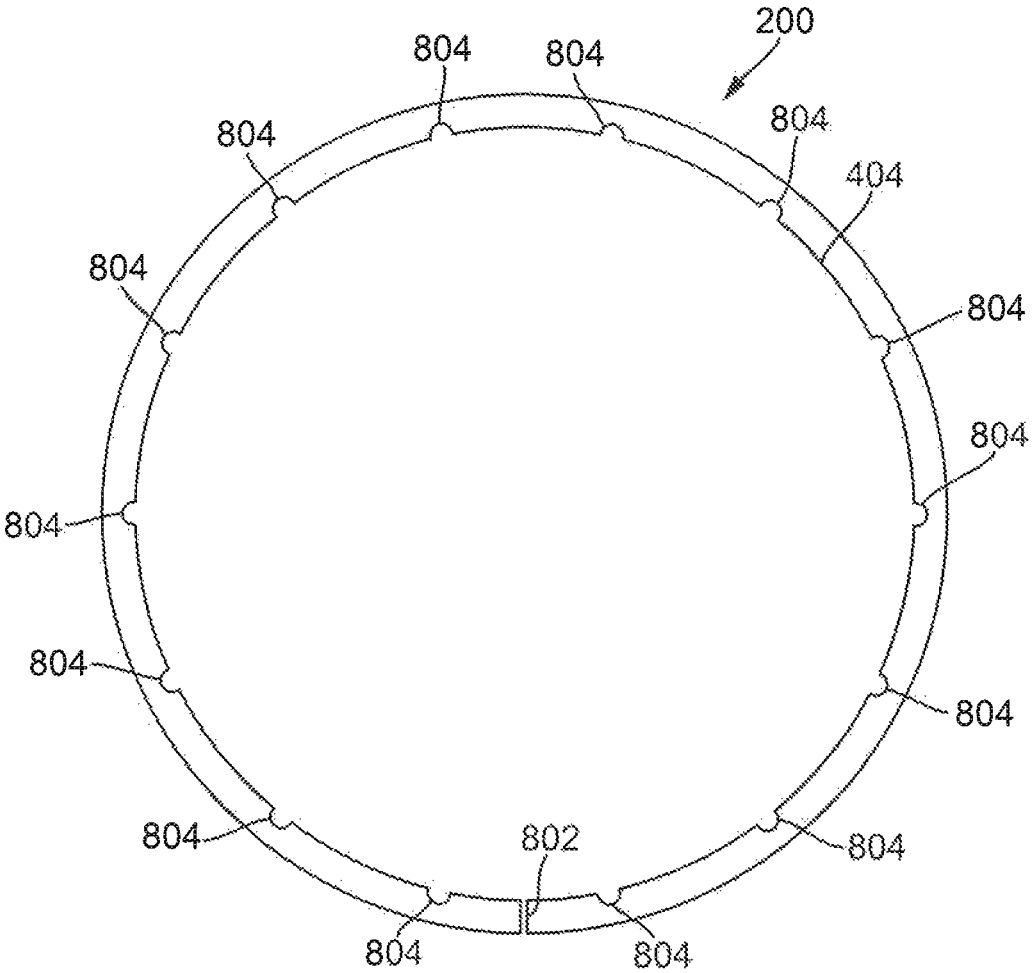
FIG. 8B is a side view of the outer section shown in FIG. 8A.
Figure 9A:
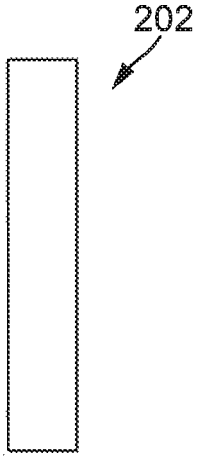
FIG. 9A is a top view of a central section for a heat shield, according to an embodiment.
Figure 9B:
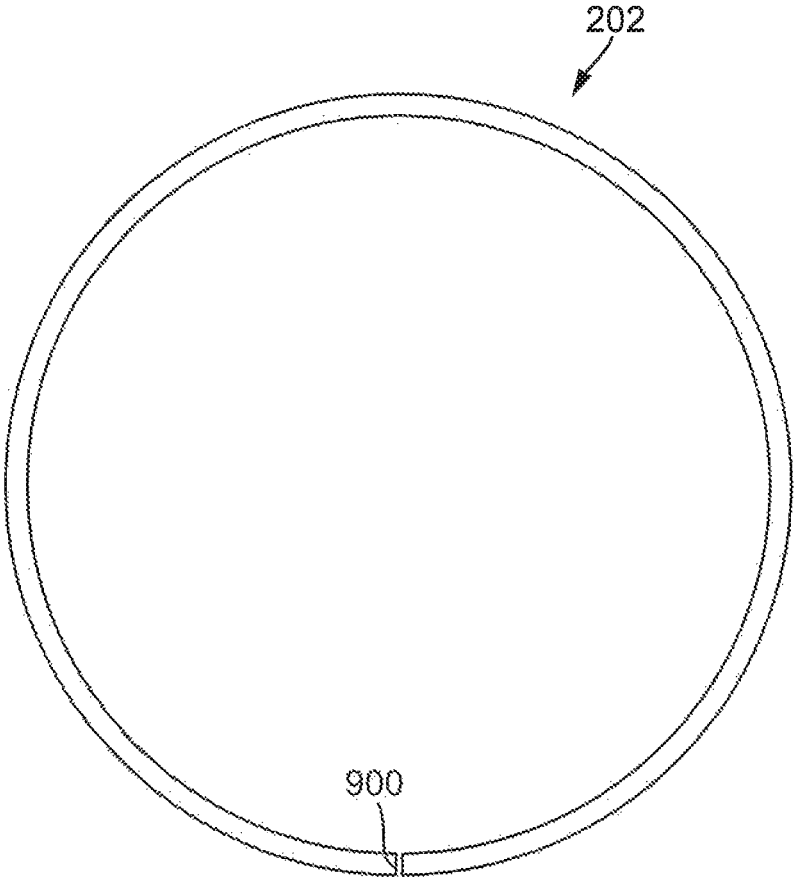
FIG. 9B is a side view of the central section shown in FIG. 9A.

In various embodiments, the outer sections 200 and the central section 202 are axially cut along a separation line, forming a mating interface 802 in the outer sections 200, as shown in FIG. 8B, and forming a mating interface 900 in the central section 202, as shown in FIG. 9B. The mating interface 802 and the mating interface 900 facilitate selective expansion of the outer sections 200 and the central section 202, respectively. In this way, the mating interface 802 and the mating interface 900 facilitate use of the heat shield 124 with fittings of various sizes. For example, the mating interface 802 in the outer sections 200 allows the outer sections 200 to be expanded over a fitting having a relatively large diameter. Similarly, the mating interface 900 facilitates expansion of the central section 202 to account for the expansion in the outer sections 200.

In some applications, an axial gap is formed along the outer sections 200 and the central section 202. This axial gap may be formed when the outer sections 200 and the central section 202 are expanded along the separating line, using the mating interface 802 and the mating interface 900. In these applications, the heat shield 124 may implement an axial cover 208 to substantially cover (e.g., overlap, etc.) the axial gap. In some embodiments, the axial cover 208 includes tapered ends. The tapered ends may have a taper that substantially matches a taper of the coupling ends 206.

Figure 2:
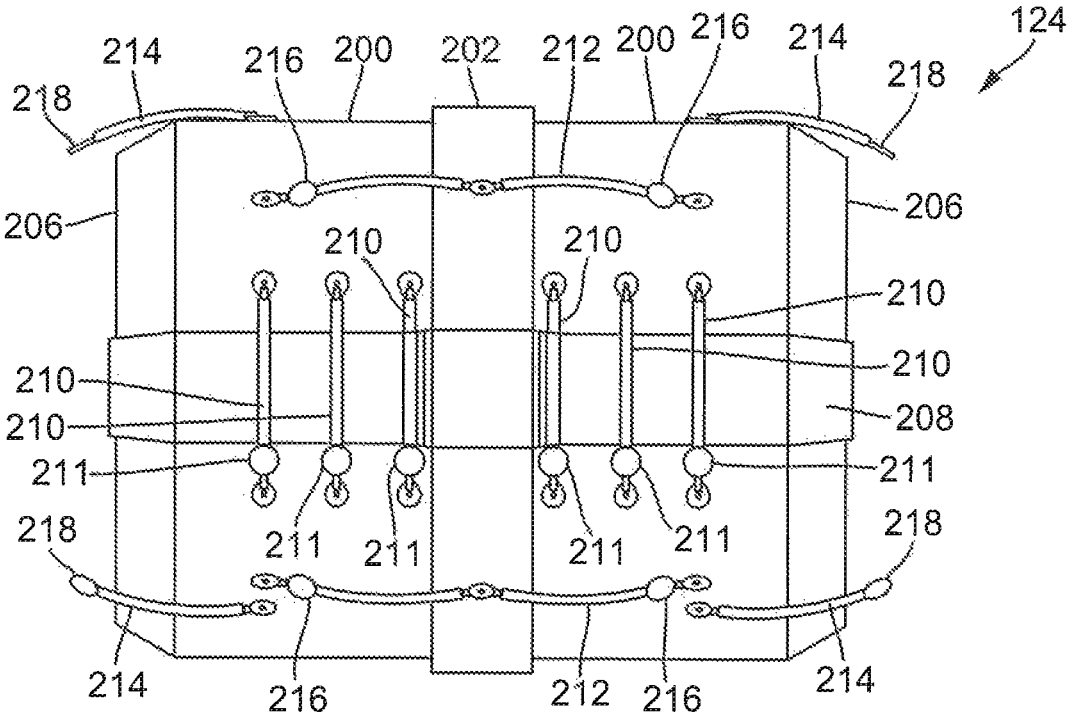
FIG. 2 is a top view of the heat shield shown in FIG. 1A.

In operation, the heat shield 124 is subject to vibrations. These vibrations may be transmitted from the bellows 126 to the heat shield 124 and/or from fittings to which the heat shield 124 and/or the bellows 126 is connected to the heat shield 124. For example, the internal combustion engine may vibrate at different frequencies depending on an operating characteristic (e.g., torque, crankshaft speed, etc.) of the internal combustion engine. According to various embodiments, the heat shield 124 further includes a plurality of circumferential ties 210. The circumferential ties 210 bridge the mating interface 802 in the outer sections 200 such that the heat shield 124 is maintained on the bellows 126 and/or the fitting. The circumferential ties 210 are configured to hold the outer sections 200 together such that the heat shield 124 remains maintained on the bellows 126. According to various embodiments, the circumferential ties 210 interface with holes in the outer sections 200 and rings 211 coupled to the outer sections 200. The rings 211 may be secured to the outer sections 200 through the use of fasteners (e.g., rivets, etc.). As shown in FIG. 2, some of the circumferential ties 210 overlap the axial cover 208 and some of the circumferential ties 210 are overlapped by the axial cover 208.

The heat shield 124 further includes a plurality of central ties 212 and a plurality of coupling ties 214. The central ties 212 are coupled to the outer sections 200 and the central section 202. The central ties 212 ensure the position of the central section 202 relative to the outer sections 200. The central ties 212 may interface with hooks 216 that are coupled to the outer sections 200. The coupling ties 214 are coupled to the outer sections 200 and configured to be coupled to a structure (e.g., the fitting, the bellows 126, the exhaust manifold, etc.). The coupling ties 214 may interface with hooks 218 that are coupled to the structure. According to various embodiments, any of the circumferential ties 210, the central ties 212, and the coupling ties 214 may be, for example, cables, wires, cords, ropes, and other similar structures. In some embodiments, any of the circumferential ties 210, the central ties 212, and the coupling ties 214 may be adjustable.

Figure 3:
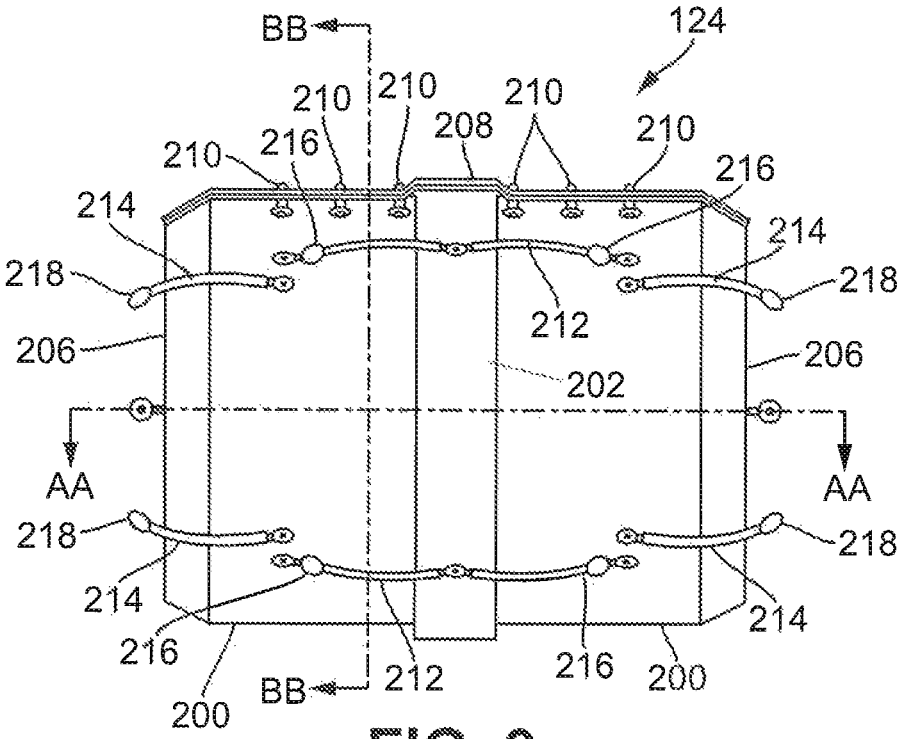
FIG. 3 is a right side view of the heat shield shown in FIG. 1A.
Figure 4:
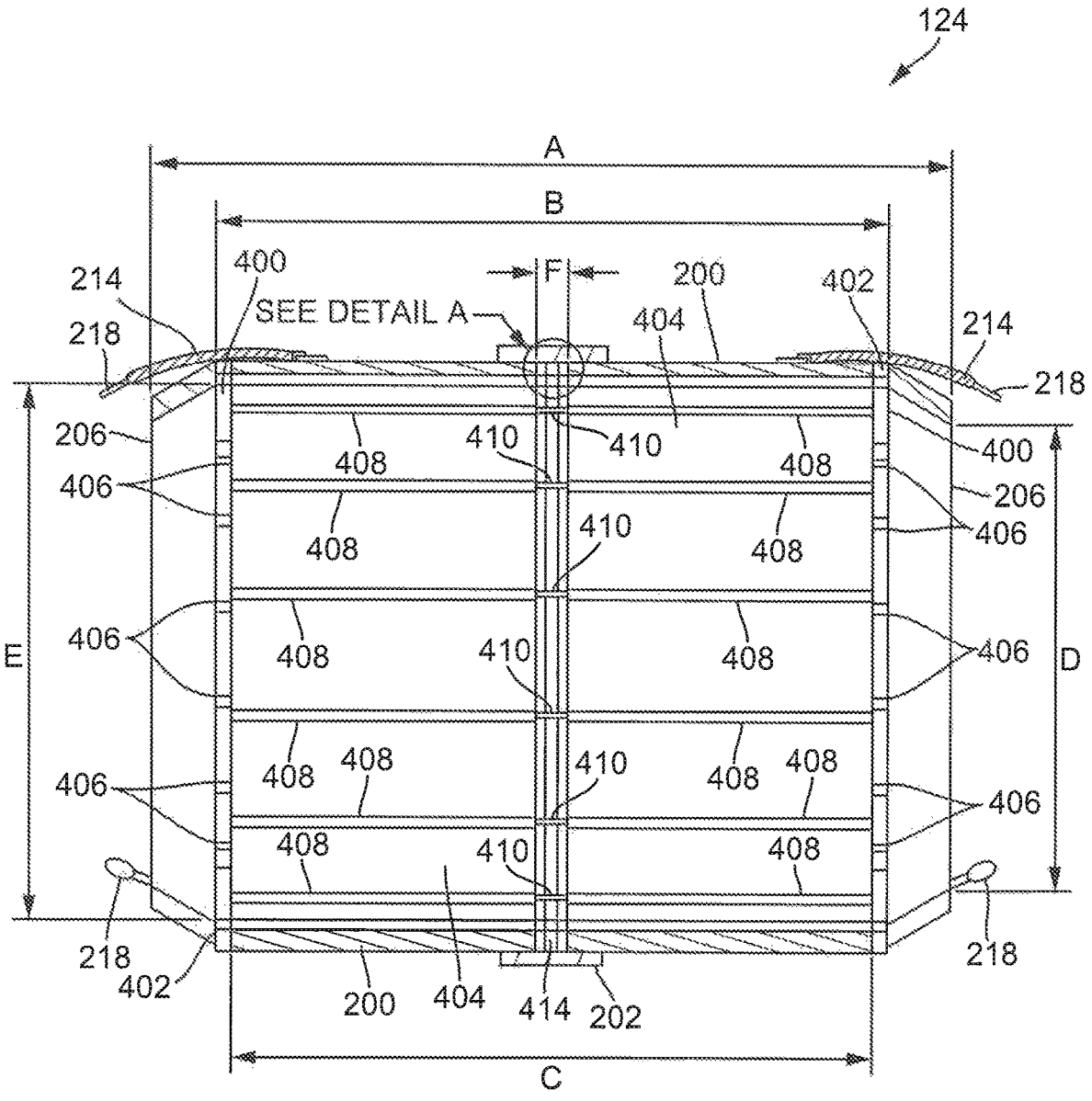
FIG. 4 is a cross-sectional view of the heat shield shown in FIG. 3, taken about line AA-AA.

FIG. 4 is a cross-sectional view of the heat shield 124 taken about line AA-AA in FIG. 3. The heat shield 124 includes two annular inserts 400. The annular inserts 400 are structurally coupled to the outer sections 200. As shown in FIG. 4, the annular inserts 400 are each positioned in annular grooves 402 in the outer sections 200. In one example, each of the annular inserts 400 is adhesively attached to one of the annular grooves 402. The annular grooves 402 are located along an inner surface 404 of the outer sections 200. The annular grooves 402 are positioned proximate the coupling ends 206 of the outer sections 200. The annular inserts 400 are configured to substantially mate with the inner surface 404 circumferentially about the annular grooves 402. The annular inserts 400 may provide structural support to the heat shield 124. The annular inserts 400 may also function to partially or completely secure the heat shield 124 to the bellows 126 (e.g., to prevent axial shifting of the heat shield 124 relative to the bellows 126, etc.).

Each of the annular inserts 400 includes a plurality of slots 406 (e.g., a first slot, a second slot, a third slot, etc.). The plurality of slots 406 is circumferentially disposed about each of the annular inserts 400. The heat shield 124 also includes a plurality of pipes 408 and a plurality of rods 410. The pipes 408 are received in the slots 406. The interface between the pipes 408 and the slots 406 is configured to substantially maintain the position of the pipes 408 relative to the slots 406. The rods 410 are configured to be slidably received within the pipes 408. According to an exemplary embodiment, the heat shield 124 includes a first number of pipes 408 and a second number of rods 410 that is equal to half of the first number, where the first number is an even integer. In one embodiment, the heat shield 124 includes twenty-eight pipes 408 and fourteen rods 410.

The pipes 408 are each defined by a first length and the rods 410 are each defined by a second length greater than the first length. According to an exemplary embodiment, the length of the rods 410 is approximately twice the length of the pipes 408. According to various embodiments, each of the pipes 408 is substantially fixed to one of the plurality of slots 406. As a result, the heat shield 124 facilitates movement of the annular inserts 400 relative to the rods 410, which slide within the pipes 408 with movement of the annular inserts 400. Because the annular inserts 400 are structurally coupled to the outer sections 200, movement of the outer sections 200 is translated to movement of the rods 410 relative to the pipes 408. For example, as a component to which the hook 218 is attached moves, the coupling ties 214 may cause a force on the outer section 200 and a corresponding movement. This corresponding movement may be facilitated by the sliding interaction between the pipes 408 and the rods 410. During movement of the heat shield 124, none of the pipes 408 and the rods 410 contact the flexible member 148 of the bellows 126. Further, none of the outer sections 200, the central section 202, and the annular inserts 400 contact the flexible member 148 of the bellows 126.

The heat shield 124 includes a center gap 414 between the outer sections 200. The center gap 414 is covered by the central section 202. According to one embodiment, the pipes 408 do not extend into the center gap 414 and the rods 410 bridge the center gap 414 between aligned pipes 408. The center gap 414 is defined by a length. The length of the center gap 414 is related to a length of the pipes 408 and the rods 410. The length of the center gap 414 defines a maximum axial displacement of the outer sections 200. For example, if the center gap 414 is two centimeters long, the outer sections 200 can only move two net centimeters towards the center gap 414. In this way, the larger the length of the center gap 414, the more movement of the outer sections 200 is possible.

Figure 5:
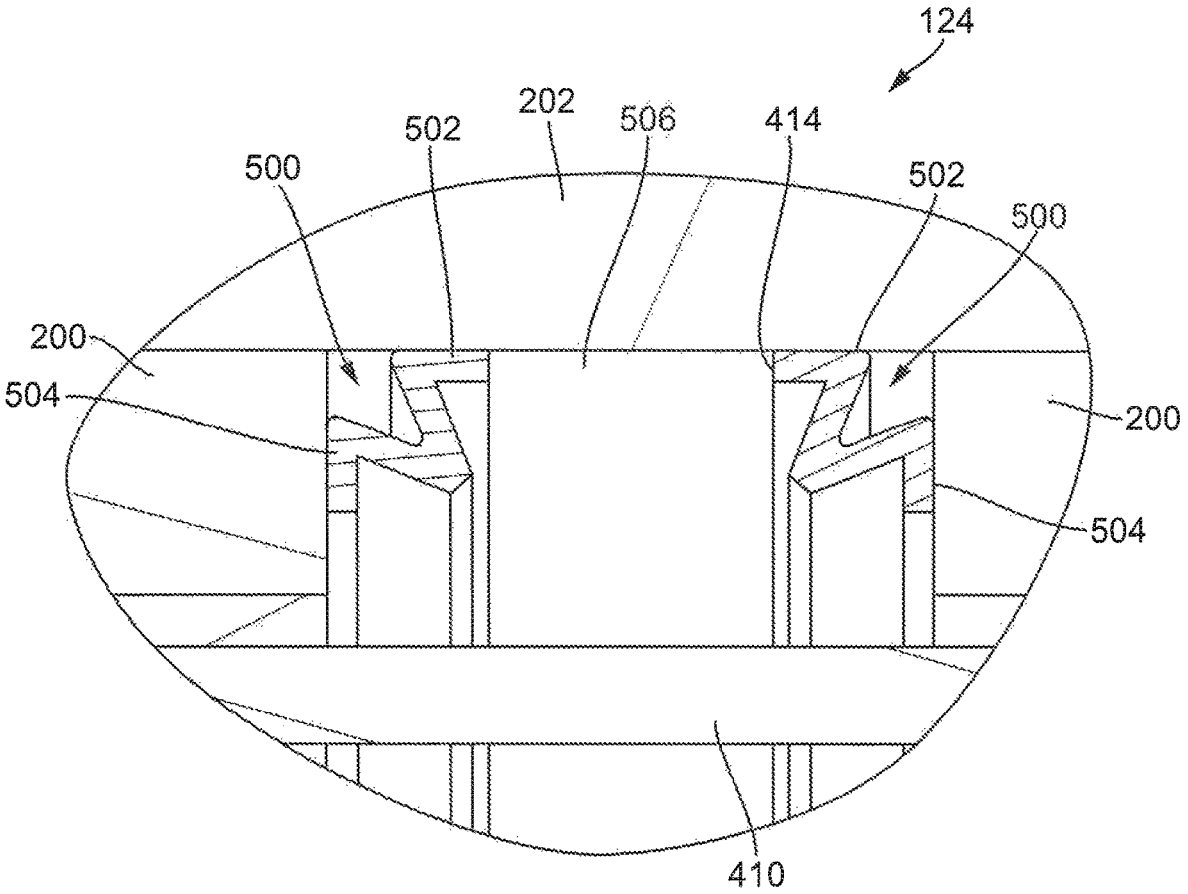
FIG. 5 is a detailed view of DETAIL A shown in FIG. 4.
Figure 6:
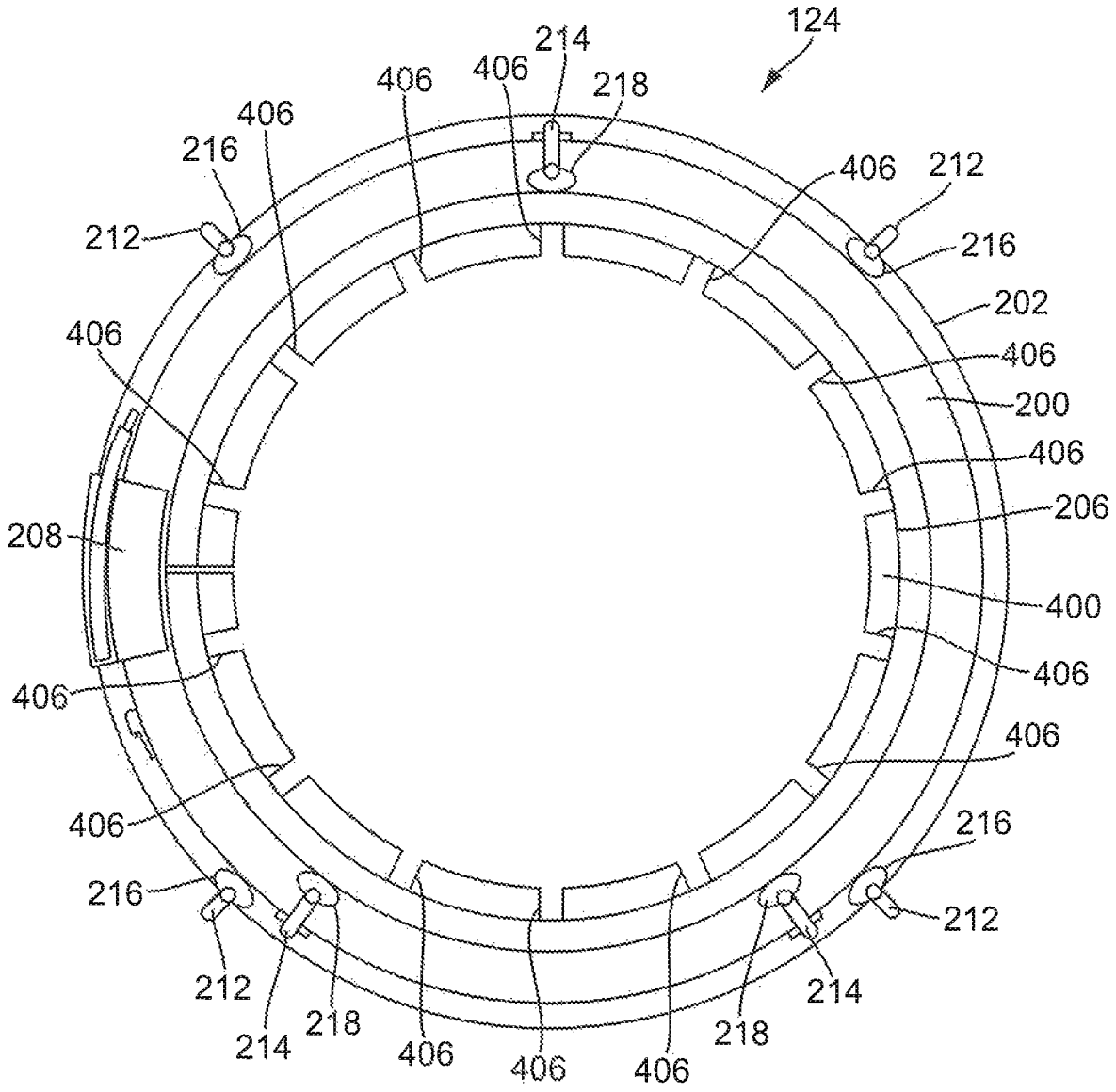
FIG. 6 is a rear view of the heat shield shown in FIG. 1A.
Figure 7:
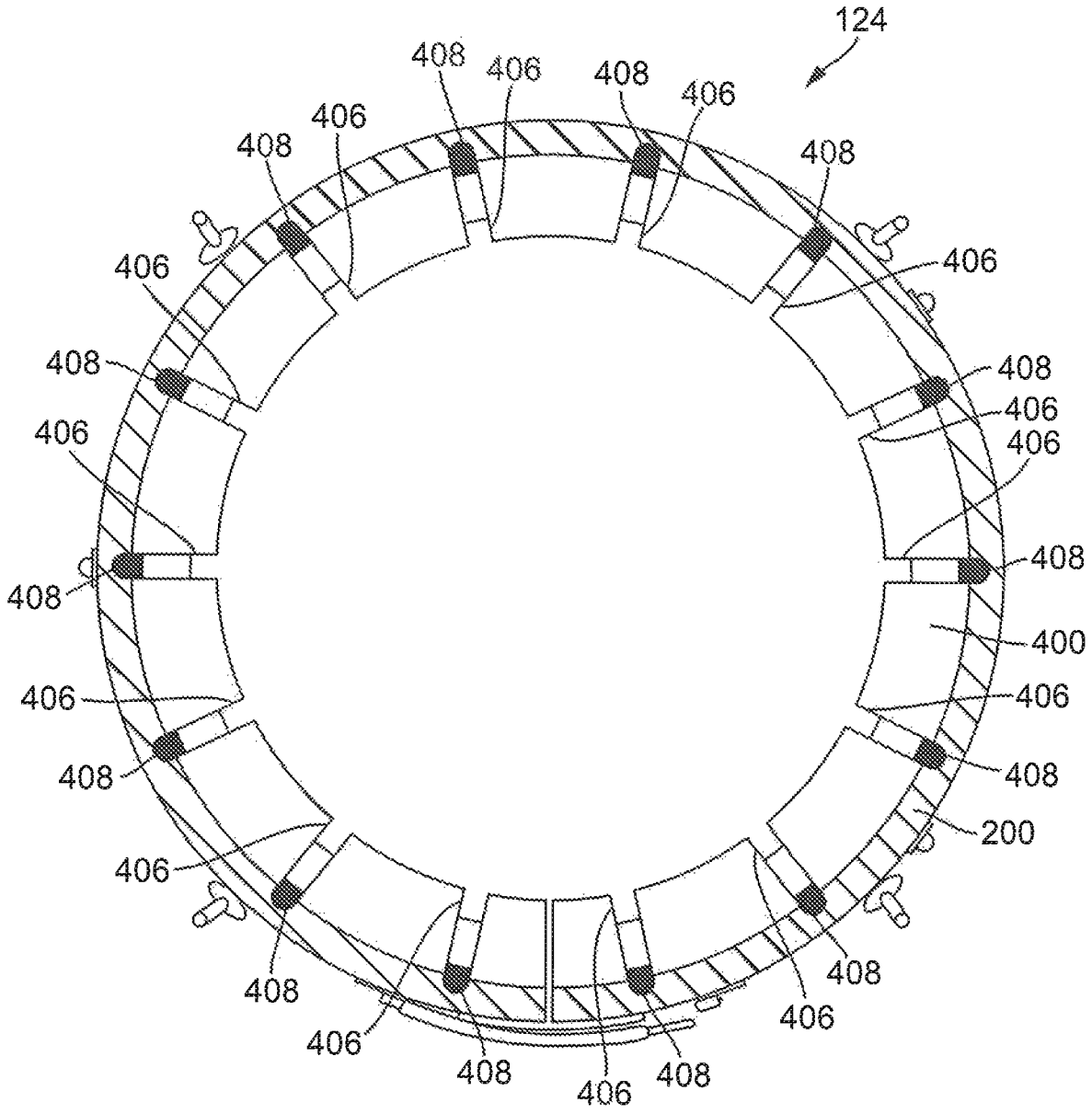
FIG. 7 is a cross-sectional view of the heat shield shown in FIG. 3, taken about line BB-BB.

FIG. 5 illustrates DETAIL A shown in FIG. 4. In addition to the pipes 408, the rods 410, and the annular inserts 400, the heat shield 124 includes two annular flexion members 500. Each of the annular flexion members 500 includes a first portion 502 that is coupled (e.g., structurally attached, etc.) to the central section 202 and a second portion 504 that is coupled to one of the outer sections 200. The annular flexion members 500 are configured to operate between a compressed state and an extended state. In the compressed state, the outer section 200 is brought as close as possible to the other outer section 200 and the other outer section 200 is held stationary. In the extended state, the outer section 200 is brought as far away as possible from the other outer section 200 and the other outer section 200 is held stationary. The annular flexion members 500 are ring shaped and extend along an inner surface 506 of the central section 202.

The design of the heat shield 124 facilitates movement of the heat shield 124 with the bellows 126 while the heat shield 124 remains coupled to a first component via a first one of the coupling ends 206 and to a second component via a second one of the coupling ends 206. In this way, the heat shield 124 may be subject to significantly less wear than conventional insulation mechanisms (e.g., wraps, etc.), thereby providing an increased useful life of the heat shield 124 compared to conventional insulation mechanisms.

According to various embodiments, the annular flexion members 500 are adhesively attached to each of the central section 202 and one of the outer sections 200. In other embodiments, any of the outer sections 200, the central section 202, and the annular flexion members 500 are combined. For example, each of the outer sections 200 may be integrated with the annular flexion members 500, which are either integrated with the central section 202 or adhesively attached to the central section 202. In one embodiment, one outer section 200 is integrated with one annular flexion member 500, which is integrated with the central section 202, which is integrated with another annular flexion member 500, which is integrated with another outer section 200, thereby forming a single member.

As shown in FIG. 8B, the outer section 200 includes a plurality of recesses 804 disposed along the inner surface 404. The recesses 804 are formed by a deformation of the outer section 200 around one of the pipes 408. For example, if the outer section 200 is constructed from a flexible material (e.g., fabric, etc.) the outer section 200 is capable of deforming around the pipes 408, thereby forming the recesses 804. In other embodiments, the recesses 804 are formed in the outer section 200. For example, the recess 804 may be molded into the outer section 200. In these applications, the slots 406 in the annular insert 400 are aligned with the recesses 804 such that each of the pipes 408 are received in one slot 406 and one recess 804 and the recesses 804 cooperate with the slots 406 to maintain the position of the pipes 408 during operation.

Figure 10A:
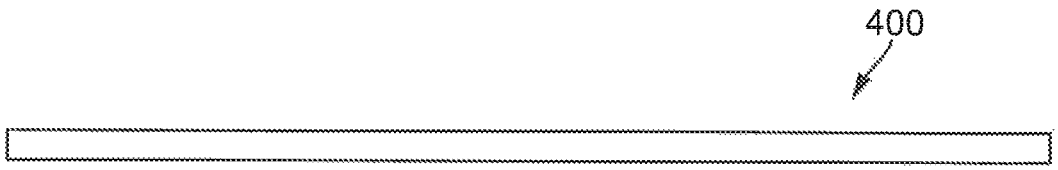
FIG. 10A is a top view of an annular insert for a heat shield, according to an embodiment.
Figure 10B:
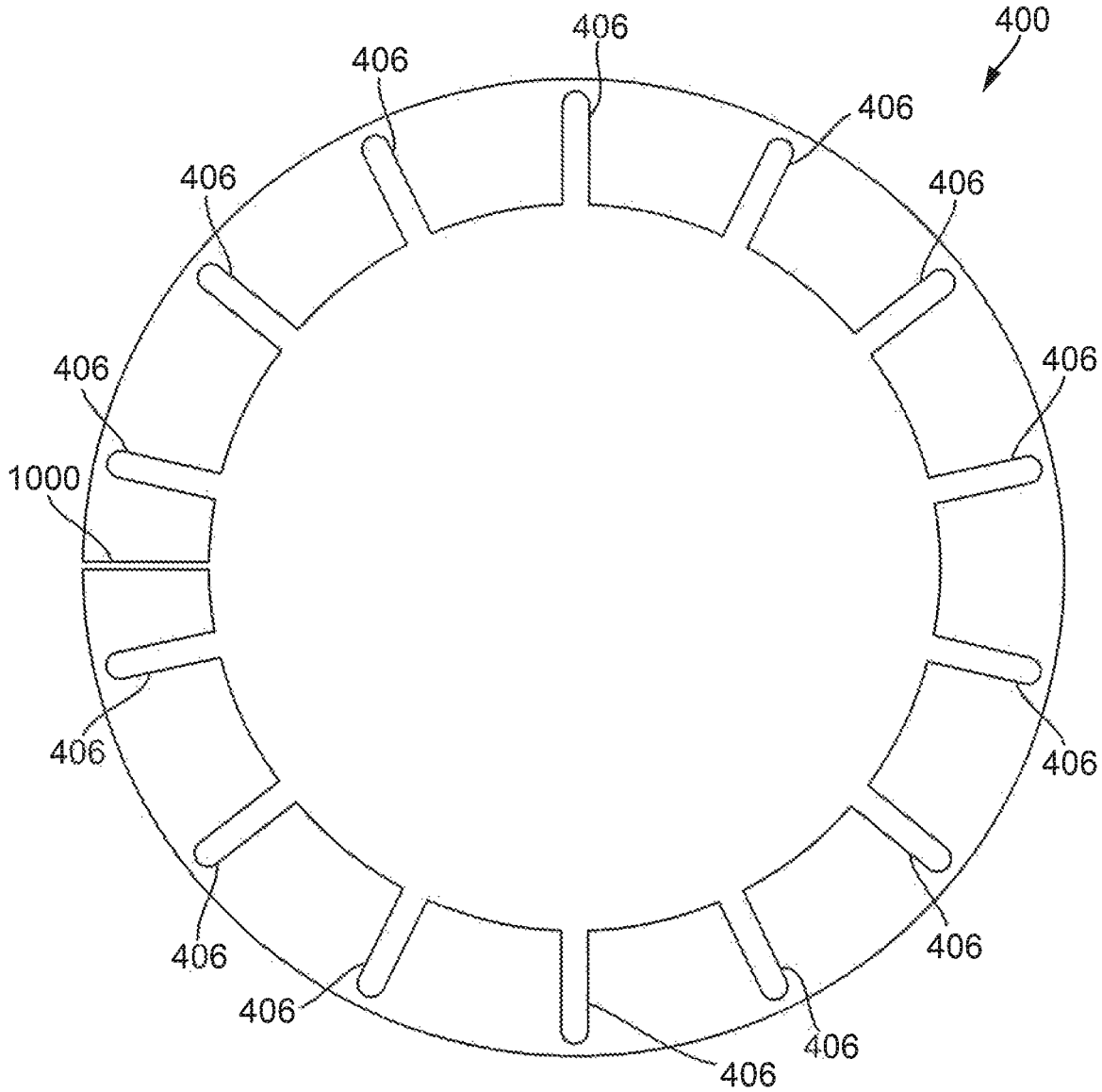
FIG. 10B is a side view of the annular insert shown in FIG. 10A.

FIGS. 10A and 10B illustrate the annular insert 400 in greater detail. As shown in FIG. 10B, the annular insert includes a mating interface 1000. Similar to the mating interface 802 and the mating interface 900, the mating interface 1000 facilitates selective expansion of the annular insert 400 such that the annular insert 400 may be utilized with a variety of different fittings and bellows, such as the bellows 126.

Figure 11A:
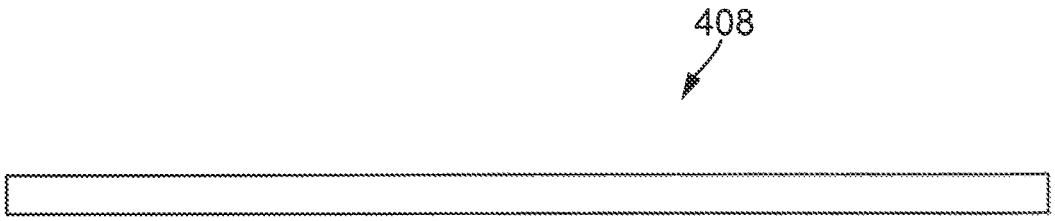
FIG. 11A is a top view of a pipe for a heat shield, according to an embodiment.
Figure 11B:
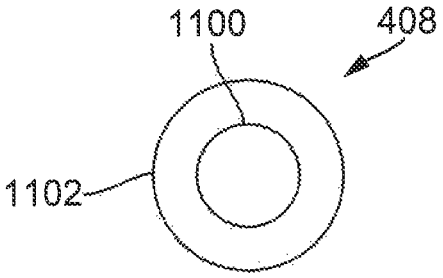
FIG. 11B is a side view of the pipe shown in FIG. 11A.

FIGS. 11A and 11B illustrate the pipe 408 in greater detail. As shown in FIG. 11B, the pipe includes an aperture 1100 and an outer surface 1102. The aperture 1100 is configured to receive the rod 410. The aperture 1100 is aligned with a central axis of the pipe 408. The outer surface 1102 is configured to interface with the recess 804 and the slot 406.

Figure 12A:
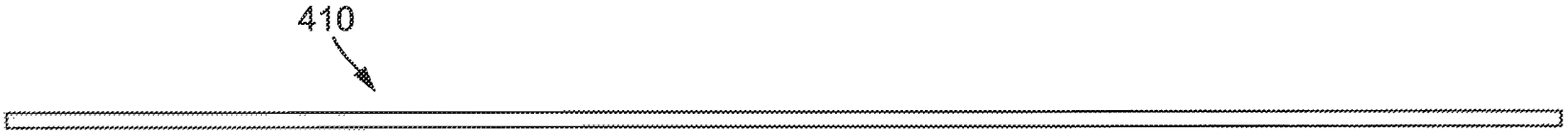
FIG. 12A is a top view of a rod for a heat shield, according to an embodiment.
Figure 12B:
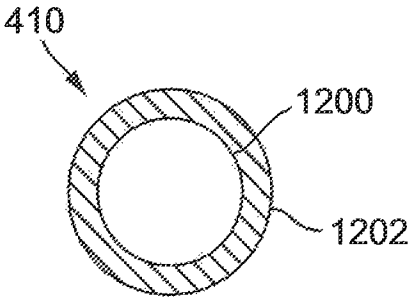
FIG. 12B is a side view of the rod shown in FIG. 12A.

FIGS. 12A and 12B illustrate the rod 410 in greater detail. As shown in FIG. 12B, the rod 410 includes an aperture 1200 and an outer surface 1202. In some embodiments, the rod 410 is solid and does not include the aperture 1200. The outer surface 1202 of the rod 410 is defined by a first diameter, and the aperture 1100 of the pipe 408 is defined by a second diameter greater than the first diameter. The difference between the diameter of the aperture 1100 of the pipe 408 and the diameter of the outer surface 1202 of the rod 410 is related to a resistive force associated with expanding and contracting the heat shield 124. For example, if the difference between the diameter of the aperture 1100 of the pipe 408 and the diameter of the outer surface 1202 of the rod 410 is small, the resistive force associated with expanding and contracting the heat shield 124 will be greater than if the difference between the diameter of the aperture 1100 of the pipe 408 and the diameter of the outer surface 1202 of the rod 410 were large.

The heat shield 124 is configured to facilitate operation in an environment associated with an internal combustion engine. For example, the heat shield 124 is constructed from material that is capable of withstanding temperatures of approximate five hundred degrees Celsius. To this end, the outer sections 200, the central section 202, and the axial cover 208 may be silicon coated. According to various embodiments, the heat shield 124 is configured such that none of the inner surface 404 of the outer sections 200, the inner surface 506 of the central section 202, the pipes 408, the rods 410, and the annular insert 400 contact the bellows 126 in operation.

Depending on the application, the heat shield 124 may be configured such that different extensions and contractions of the heat shield 124 are possible. According to various embodiments, the heat shield 124 is configured to facilitate an expansion of at least thirty millimeters and a contraction of at least thirty millimeters.

Depending on the application, any of the outer sections 200, the central section 202, and the annular flexion members 500 may be constructed from fabric (e.g., thermal resistant fabric, tear resistant fabric, composite fabric, etc.). The pipes 408 and the rods 410 may be constructed from various metals such as steel, aluminum, titanium, and other similar metals. In one embodiment, the pipes 408 and the rods 410 are constructed from a low carbon steel. The annular inserts 400 may be constructed from various foams, metals, polymers, and composites. According to one embodiment, the annular inserts 400 are constructed from a stiff foam. Various components of the heat shield 124 may be coated (e.g., with a heat resistant coating, with a lubricating coating, etc.), painted, or otherwise treated.

Referring again to FIG. 4, dimensions A, B, C, D, E, and F are illustrated. According to an exemplary embodiment, the heat shield 124 has a dimension A of approximately six-hundred and sixty-nine millimeters, a dimension B of approximately 567.4 millimeters, a dimension C of approximately five-hundred and forty-two millimeters, a dimension D of approximately three-hundred and ninety-five millimeters, a dimension E of approximately four-hundred and fifty millimeters, and a dimension F of at least thirty millimeters. In some embodiments, dimension B is approximately 567.4 millimeters plus or minus five millimeters and dimension D is approximately three-hundred and ninety-five millimeters plus or minus seven millimeters. Other similar quantities for dimensions A, B, C, D, F, and F are also possible.

Each of the outer sections 200 is defined by a length from the coupling end 206 to the central end 800. According to an exemplary embodiment, the length of each of the outer sections 200 is approximately 268.7 millimeters. In some embodiments, the length of each of the outer sections 200 is approximately 268.7 millimeters plus or minus five millimeters. Each of the outer sections 200 is also defined by an inner diameter and by an outer diameter. According to an exemplary embodiment, the inner diameter of each of the outer sections 200 is at least four-hundred and fifty-two millimeters and the outer diameter of each of the outer sections 200 is at most four-hundred and ninety-five millimeters. Other similar quantities for the length, the inner diameter, and the outer diameter of the outer sections 200 are also possible.

The central section 202 is defined by a length, an inner diameter, and an outer diameter. According to an exemplary embodiment, the length of the central section 202 is approximately one-hundred and twenty millimeters, the inner diameter is approximately four-hundred and ninety-five millimeters, and the outer diameter is at most approximately five-hundred and twenty millimeters. In some embodiments, the length of the central section 202 is approximately ninety millimeters. Other similar quantities for the length, the inner diameter, and the outer diameter of the central section 202 are also possible. The inner diameter of the central section 202 is directly related to the outer diameter of the outer sections 200.

Each of the annular inserts 400 is defined by a length, an outer diameter, and an inner diameter (measured between the slots 406 and not within the slots 406). According to an exemplary embodiment, the length of each of the annular inserts 400 is approximately 12.7 millimeters, the inner diameter of each of the annular inserts 400 is approximately three-hundred and sixty millimeters, and the outer diameter of each of the annular inserts 400 is approximately four-hundred and eighty-five millimeters. In some embodiments, the length of each of the annular inserts 400 is approximately 12.7 millimeters plus or minus five millimeters, the inner diameter of each of the annular inserts 400 is approximately three-hundred and sixty millimeters plus or minus one millimeter, and the outer diameter of each of the annular inserts 400 is approximately four-hundred and eighty-five millimeters plus or minus five millimeters. Other similar quantities for the length, the inner diameter, and the outer diameter of each of the annular inserts 400 are also possible.

Each of the pipes 408 is defined by a length, an inner diameter (e.g., a diameter of the aperture 1100), and an outer diameter (e.g., a diameter of the outer surface 1102). According to an exemplary embodiment, the length of each of the pipes 408 is approximately 268.7 millimeters, the inner diameter of each of the pipes 408 is approximately 5.461 millimeters, and the outer diameter of each of the pipes 408 is approximately 10.287 millimeters. In some embodiments, the length of each of the pipes 408 is approximately 268.7 millimeters plus or minus one millimeter. Other similar quantities for the length, the inner diameter, and the outer diameter of each of the pipes 408 are also possible.

Each of the rods 410 is defined by a length and an outer diameter (e.g., a diameter of the outer surface 1202). According to an exemplary embodiment, the length of each of the rods 410 is approximately five-hundred and thirty-seven millimeters and the outer diameter of each of the rods 410 is approximately 4.763 millimeters (e.g., 3/16 inches, etc.). In some embodiments, the length of each of the rods 410 is approximately five-hundred and thirty-seven millimeters plus or minus one millimeter. Other similar quantities for the length and the outer diameter of each of the rods 410 are also possible.

Figure 13A:
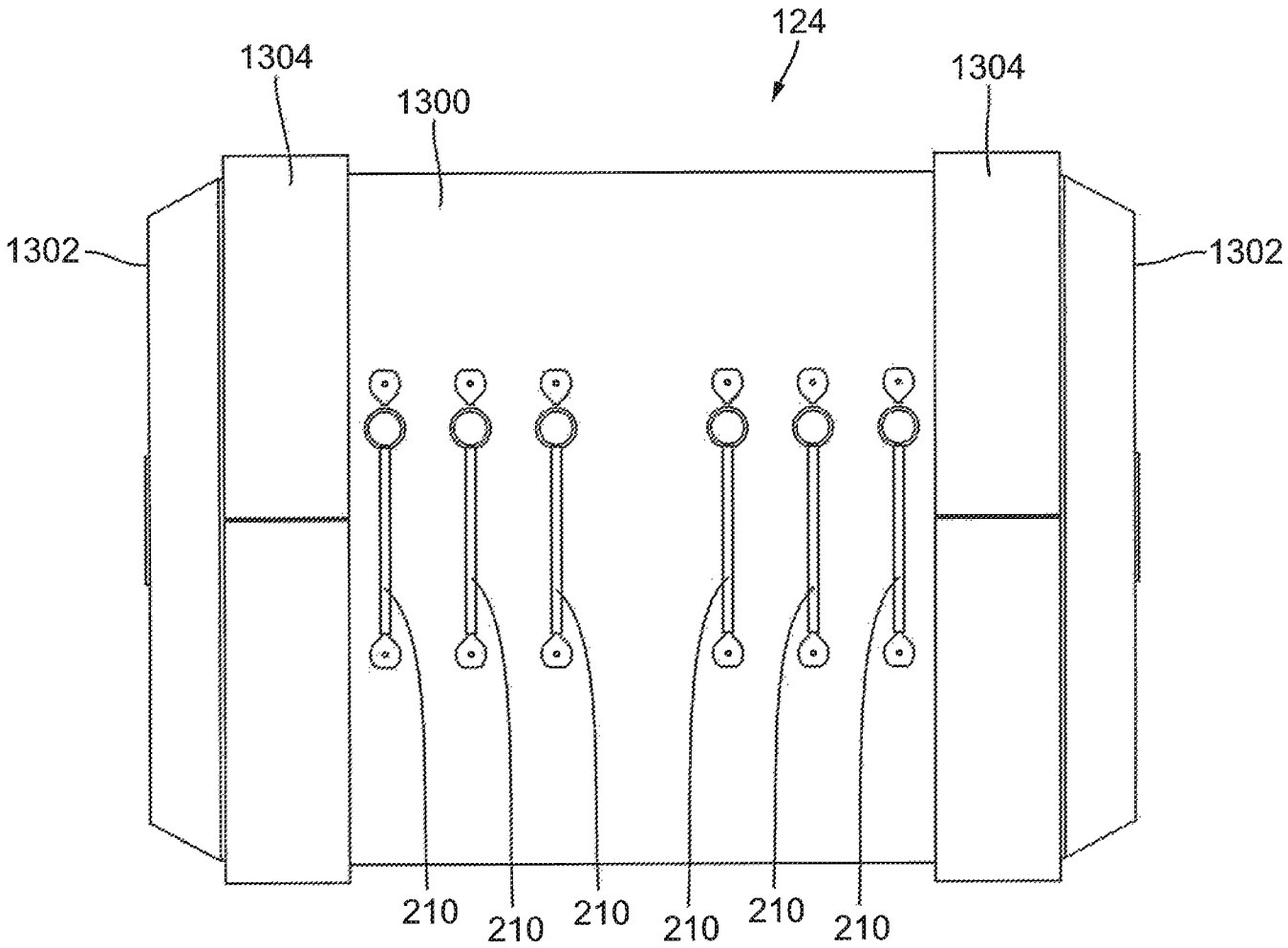
FIG. 13A is a right side view of a heat shield according to an alternative embodiment.
Figure 13B:
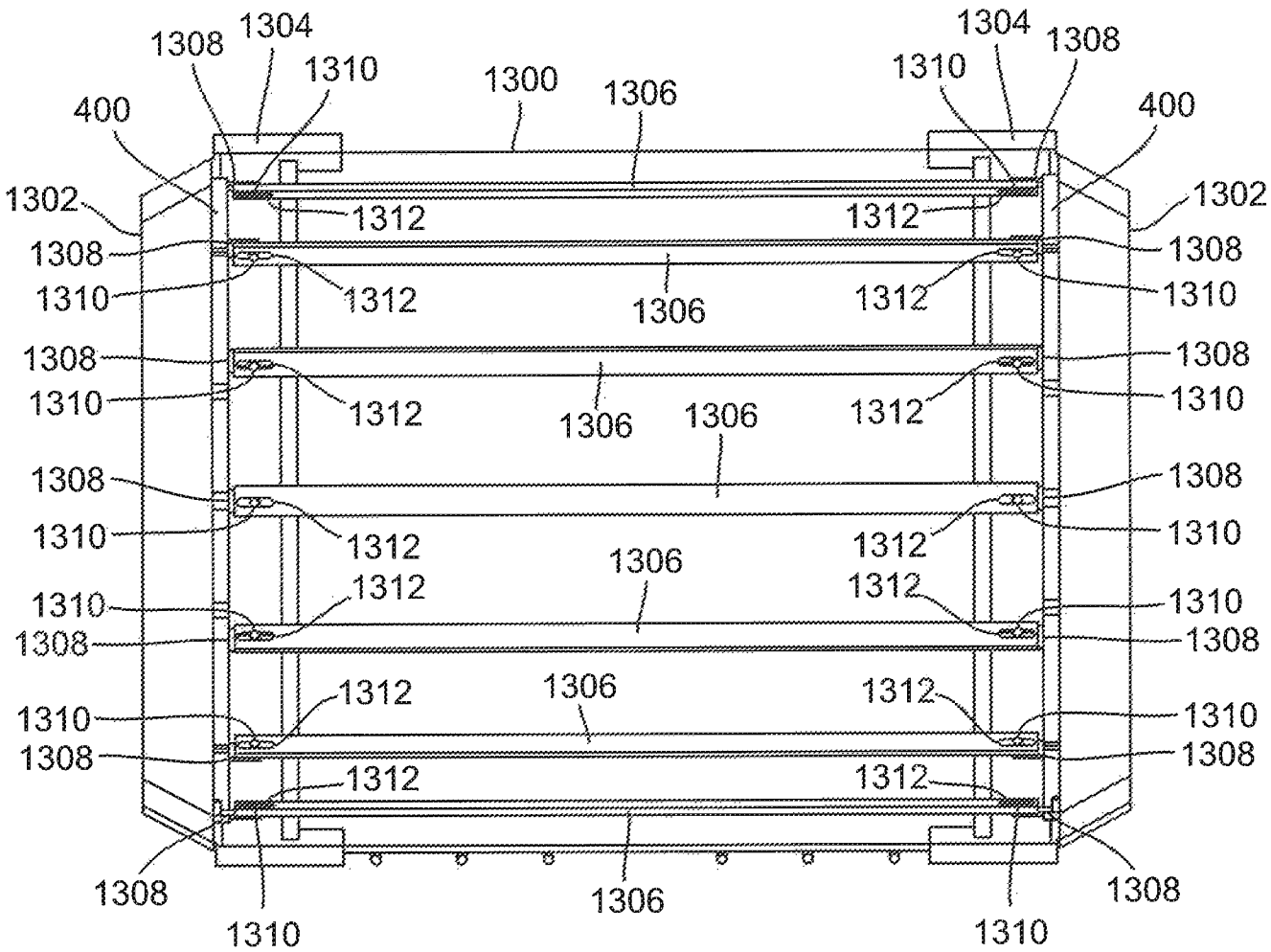
FIG. 13B is a cross-sectional view of the heat shield shown in FIG. 13A.

FIGS. 13A and 13B illustrate the heat shield 124 according to some alternative embodiments. In one embodiment, the heat shield 124 includes a main body 1300. The heat shield 124 also includes a pair of coupling ends 1302 and a pair of covers 1304. According to various embodiments, each of the pair of covers 1304 is coupled to (e.g., attached to, etc.) one of the coupling ends 1302. The pair of covers 1304 may also be integrated into the coupling ends 1302. The heat shield 124 may include the annular inserts 400 as previously described. In these applications, the annular inserts 400 may couple the heat shield 124 to the bellows 126.

Each of the coupling ends 1302 is configured to individually couple to a fitting, such as a manifold section. The coupling ends 1302 may be tapered inward from the main body 1300. In this way, the coupling ends 1302 provide a seal with the corresponding fitting. The design of the heat shield 124 facilitates movement of the heat shield 124 with the bellows 126 while the heat shield 124 remains coupled to a first component via a first one of the coupling ends 1302 and to a second component via a second one of the coupling ends 1302. In this embodiment, the heat shield 124 may include the circumferential ties 210. The circumferential ties 210 may be configured to hold the main body 1300 together such that the heat shield 124 remains maintained on the bellows 126.

As shown in FIG. 13B, the heat shield 124 includes a plurality of connectors 1306, a plurality of couplers 1308, and a plurality of protrusions 1310. The connectors 1306 are each defined by a first length and the main body 1300 is defined by a second length. In various embodiments, the first length (i.e., the length of each of the connectors 1306) is greater than the second length (i.e., the length of the main body 1300). The connectors 1306 are each attached to the main body 1300. For example, the connectors 1306 may be adhesively fixed to the main body 1300. In some embodiments, the couplers 1308 are each attached to one of the covers 1304. In other applications, at least some of the couplers 1308 are integrated within at least one of the covers 1304.

According to various embodiments, each of the protrusions 1310 are attached to one of the couplers 1308. In other applications, at least some of the protrusions 1310 are integrated within at least one of the couplers 1308. Each of the connectors 1306 includes a pair of slots 1312, one of the slots 1312 on each end of each connector 1306. Each of the slots 1312 is configured to slideably engage one of the protrusions 1310. Because the protrusions 1310 are attached to the couplers 1308, and the couplers 1308 are attached to the coupling ends 1302, which are fixed to a component, the slots 1312 move relative to the protrusions 1310 between a maximum position, where the slots 1312 contact the protrusions 1310 on one end of the slots 1312, and a minimum position, where the slots 1312 contact the protrusions 1310 on another end of the slots 1312.

In operation, a first component which is coupled to a first of the coupling ends 1302 may move relative to a second component which is coupled to a second of the coupling ends 1302. This movement causes the protrusions 1310 to move within the slots 1312. Given enough movement in one direction, the protrusions 1310 contact the slots 1312, causing a force to be transmitted along the connector 1306 and corresponding movement of the main body 1300. According to various embodiments, the number of connectors 1306 is equal to half the number of couplers 1308, half the number of protrusions 1310, and half the number of slots 1312. In an alternative embodiment, the connectors 1306 include the protrusions 1310 and the couplers 1308 include the slots 1312. In this embodiment, movement of the connectors 1306 causes movement of the protrusions 1310 within the slots 1312 in the couplers 1308. In another alternative embodiment, the connectors 1306 include a protrusion 1310 and a slot 1312. For example, a protrusion 1310 on a first end of the connector 1306 may interface with a slot 1312 in a coupler 1308 and a slot 1312 on a second end of the connector 1306 may interface with a protrusion 1310 in a coupler 1308.

Figure 14A:
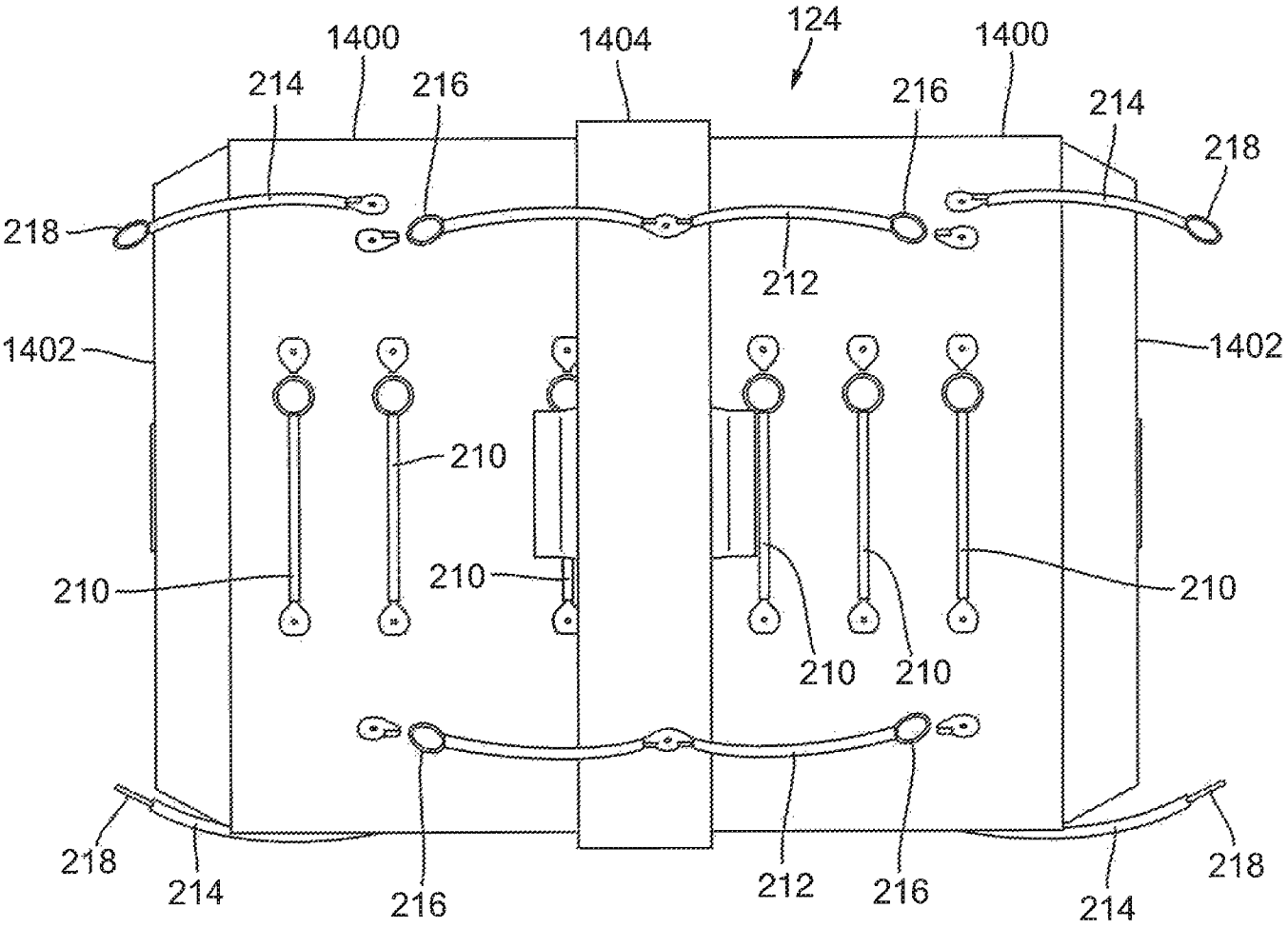
FIG. 14A is a right side view of a heat shield according to an another alternative embodiment.
Figure 14B:
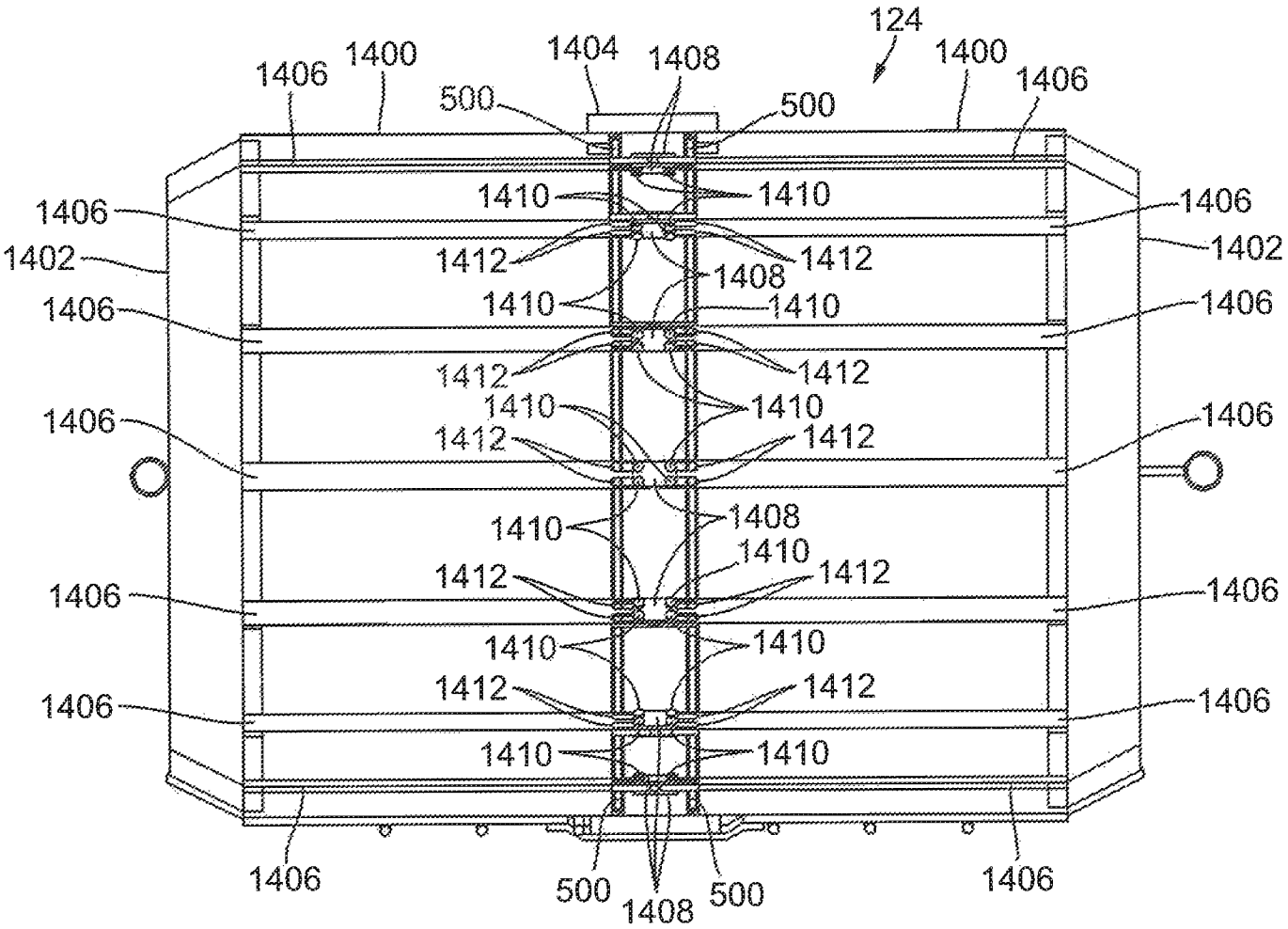
FIG. 14B is a cross-sectional view of the heat shield shown in FIG. 14A.

FIGS. 14A and 14B illustrate the heat shield 124 according to some other alternative embodiments. In one embodiment, the heat shield 124 includes two outer sections 1400. The outer sections 1400 each include a coupling end 1402. The heat shield 124 includes a central section 1404 positioned between, and adjoining, the outer sections 1400. The heat shield 124 may include the annular inserts 400 as previously described. In these applications, the annular inserts 400 may couple the heat shield 124 to the bellows 126. The heat shield 124 includes the circumferential ties 210, the central ties 212, the coupling ties 214, the hooks 216, and the hooks 218 as previously described. The central ties 212 may be attached to the central section 1404 and may be attached to the outer sections 1400 through the use of the hooks 216. The heat shield 124 also includes the annular flexion members 500 as previously described.

Each of the coupling ends 1402 is configured to individually couple to a fitting, such as a manifold section. The coupling ends 1402 may be tapered inward from the respective outer section 1400. In this way, the coupling ends 1402 provide a seal with the corresponding fitting. The design of the heat shield 124 facilitates movement of the heat shield 124 with the bellows 126 while the heat shield 124 remains coupled to a first component via a first one of the coupling ends 1402 and to a second component via a second one of the coupling ends 1402.

As shown in FIG. 14B, the heat shield 124 includes a plurality of connectors 1406, a plurality of couplers 1408, and a plurality of protrusions 1410. The connectors 1406 are each attached to one of the outer sections 1400. For example, the connectors 1406 may be adhesively fixed to the outer sections 1400. The connectors 1406 may also be integrated within the outer sections 1400. In some embodiments, the couplers 1408 are each attached to the central section 1404. In other applications, at least some of the couplers 1408 are integrated within the central section 1404.

According to various embodiments, each of the protrusions 1410 are attached to one of the couplers 1408. In other applications, at least some of the protrusions 1410 are integrated within at least one of the couplers 1408. In one embodiment, each of the connectors 1406 includes a pair of slots 1412 on one end. However, in other embodiments, each of the connectors 1406 may include one slot 1412, three slots 1412, or any other similar number of slots 1412. Each of the slots 1412 is configured to slideably engage one of the protrusions 1410. Because the protrusions 1410 are attached to the couplers 1408, and the connectors 1406 are attached to the outer sections 1400, which are fixed to a component, the slots 1412 move relative to the protrusions 1410 between a maximum position, where the slots 1412 contact the protrusions 1410 on one end of the slots 1412, and a minimum position, where the slots 1412 contact the protrusions 1410 on another end of the slots 1412.

In operation, a first component, which is coupled to a first of the coupling ends 1402, may move relative to a second component, which is coupled to a second of the coupling ends 1402. This movement causes the protrusions 1410 to move within the slots 1412. Given enough movement in one direction, the protrusions 1410 contact the slots 1412, causing a force to be transmitted along the connector 1406 to the coupler 1408, and causing corresponding movement of the central section 1404. According to various embodiments, each connector 1406 includes two slots 1412 and each coupler includes two protrusions 1410. In some embodiments, the number of connectors 1406 is equal to twice the number of couplers 1408, is equal to half the number of protrusions 1410, and is equal to half the number of slots 1412. In an alternative embodiment, the connectors 1406 include the protrusions 1410 and the couplers 1408 include the slots 1412. In this embodiment, movement of the connectors 1406 causes movement of the protrusions 1410 within the slots 1412 in the couplers 1408. In another alternative embodiment, the connectors 1406 include a protrusion 1410 and a slot 1412. For example, a protrusion 1410 of the connector 1406 may interface with a slot 1412 in a coupler 1408 and a slot 1412 of the connector 1406 may interface with a protrusion 1410 in a coupler 1408.

Figure 15A:
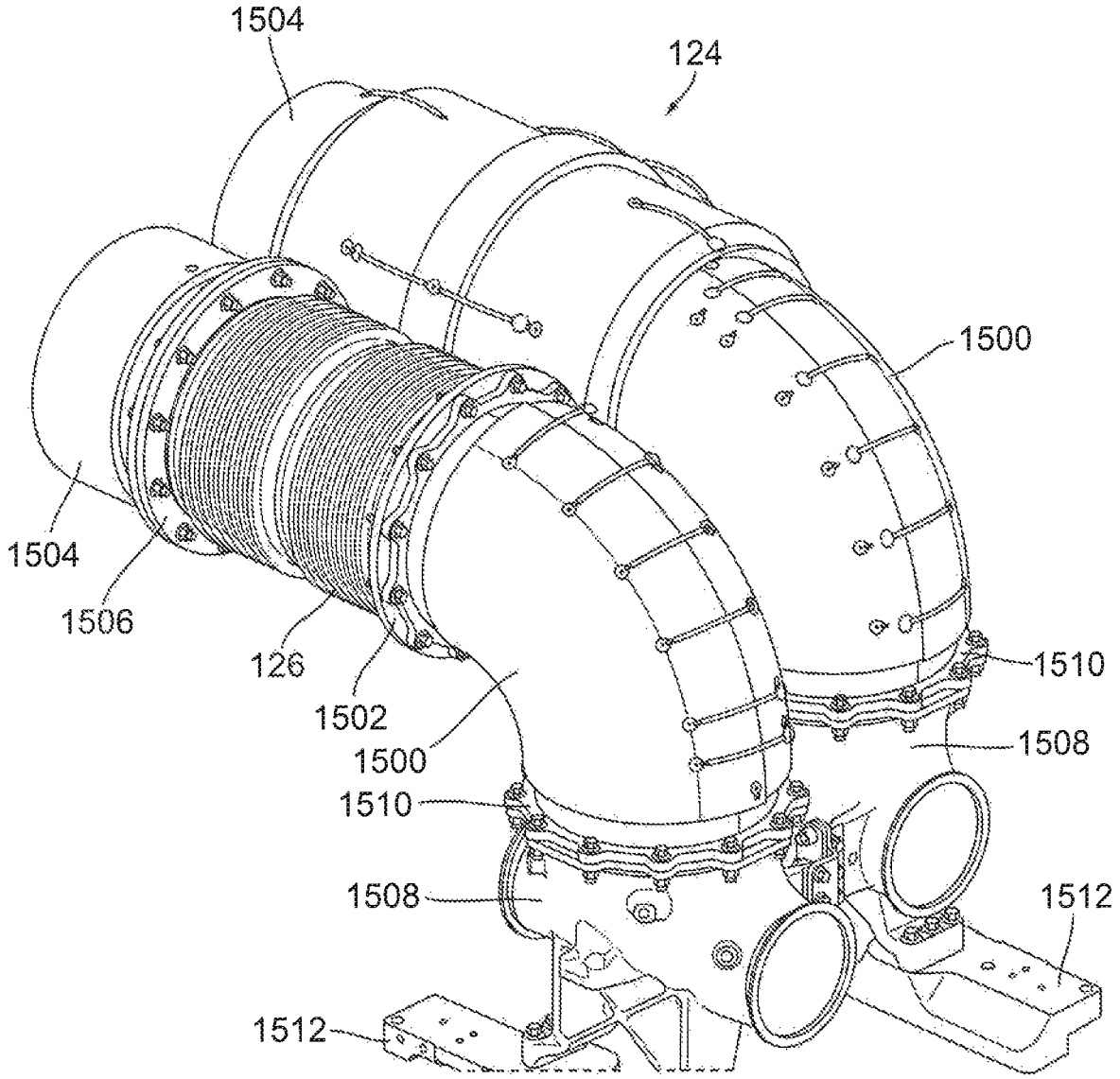
FIG. 15A is a perspective view of a heat shield installed in an exemplary application, according to an embodiment.
Figure 15B:
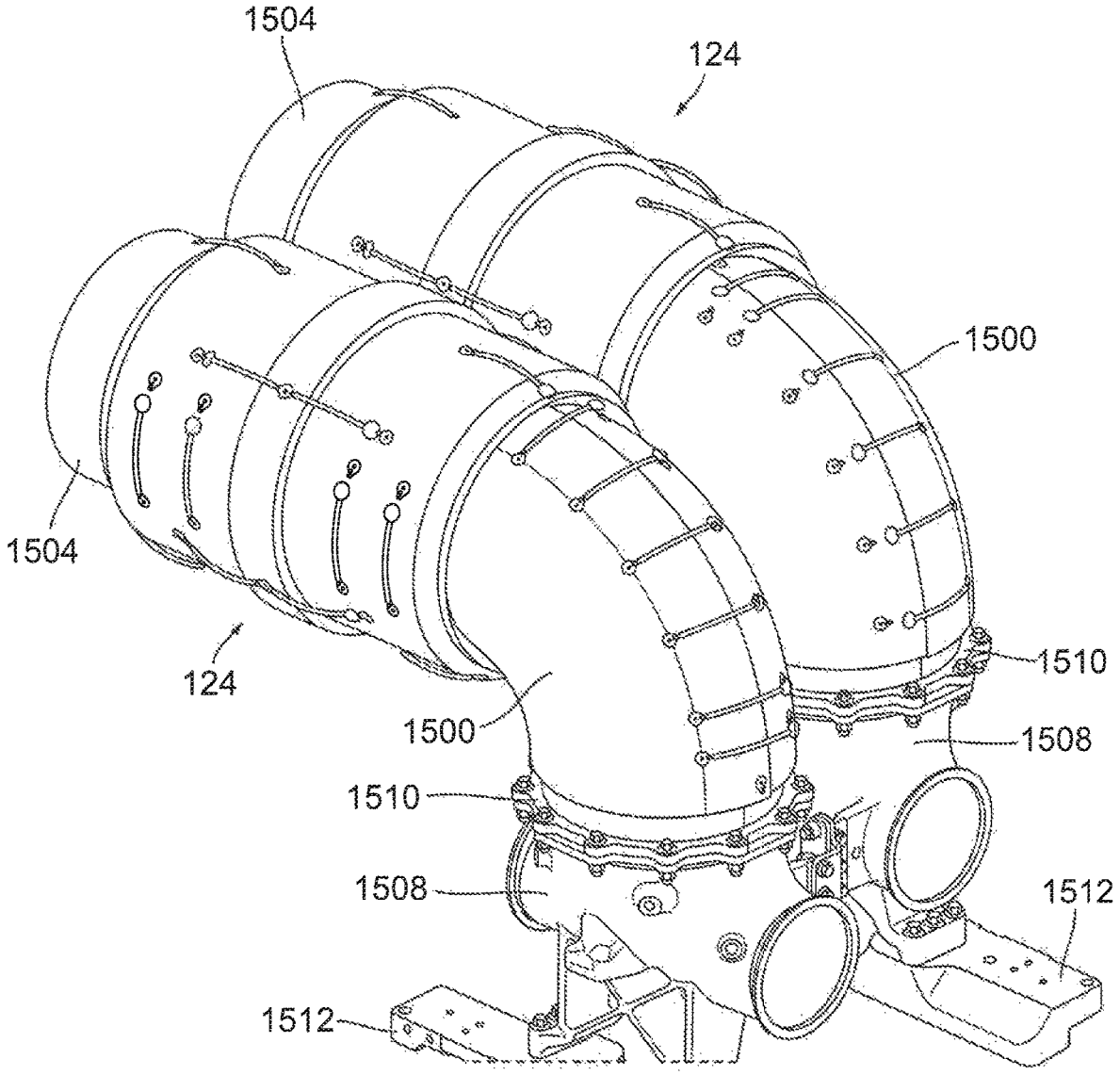
FIG. 15B is another view of the application shown in FIG. 15A.

FIGS. 15A and 15B illustrate an implementation of the heat shield 124 in an application according to an exemplary embodiment. The bellows 126 is shown for illustrative purposes only. In application, the bellows 126 is covered by the heat shield 124. The bellows 126 is coupled to a first component 1500, through a first coupler 1502, and to a second component 1504, through a second coupler 1506. The first component 1500 and the second component 1504 may be, for example, flexible conduits, pipes, fittings, and other similar amendments. Each of the first components 1502 may be coupled to a manifold 1508 through a third coupler 1510. The manifold 1508 may be attached to a structure 1512, such as a cylinder head, an engine block, a frame, and other similar components. The manifold 1508 may be, for example, an exhaust manifold, a throttle body, an air intake, an exhaust gas regeneration system, and other similar systems. The first coupler 1502, the second coupler 1506, and the third coupler 1510 may be various different types of couplers such as, for example, Marmon clamps, ring clamps, adjustable clamps, ring clamps, and other similar clamps.

While this specification contains many specific implementation details, these should not be construed as limitations on the scope of what may be claimed but rather as descriptions of features specific to particular implementations. Certain features described in this specification in the context of separate implementations or embodiments can also be implemented in combination in a single implementation or embodiment as would be understood by one of ordinary skill in the art. Conversely, various features described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

As utilized herein, the term "substantially" and any similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided unless otherwise noted. Accordingly, these terms should be interpreted as indicating that insubstantial or inconsequential modifications or alterations of the subject matter described and claimed are considered to be within the scope of the invention as recited in the appended claims. Additionally, it is noted that limitations in the claims should not be interpreted as constituting "means plus function" limitations under the United States patent laws in the event that the term "means" is not used therein.

The terms "coupled," "connected," and the like as used herein mean the joining of two components directly or indirectly to one another. Such joining may be stationary (e.g., permanent) or moveable (e.g., removable or releasable). Such joining may be achieved with the two components or the two components and any additional intermediate components being integrally formed as a single unitary body with one another or with the two components or the two components and any additional intermediate components being attached to one another.

It is important to note that the construction and arrangement of the system shown in the various exemplary implementations is illustrative only and not restrictive in character. All changes and modifications that come within the spirit and/or scope of the described implementations are desired to be protected. It should be understood that some features may not be necessary and implementations lacking the various features may be contemplated as within the scope of the application, the scope being defined by the claims that follow. It should be understood that features described in one embodiment could also be incorporated and/or combined with features from another embodiment in manner understood by those of ordinary skill in the art. It should also be noted that the terms "example" and "exemplary" as used herein to describe various embodiments are intended to indicate that such embodiments are possible examples, representations, and/or illustrations of possible embodiments (and such terms are not intended to connote that such embodiments are necessarily extraordinary or superlative examples).

What is claimed is:

1. A heat shield for a bellows, the heat shield comprising:

a central section;

a first outer section adjoining the central section, the first outer section comprising a first outer section first end and a first outer section second end opposite the first outer section first end;

a first annular insert positioned within the first outer section second end of the first outer section, the first annular insert comprising a first slot;

a first annular flexion member coupled to the first outer section first end of the first outer section and coupled to the central section, the first annular flexion member facilitating movement between the first outer section and the central section;

a first pipe partially received within the first slot in the first annular insert, the first pipe having a first length; and a first rod slidably received within the first pipe, the first rod having a second length greater than the first length;

wherein movement between the first outer section and the central section causes movement between the first pipe and the first rod.

2. The heat shield of claim 1, further comprising:

a second outer section comprising a second outer section first end and a second outer section second end opposite the second outer section first end; and a second annular flexion member coupled to the second outer section first end of the second outer section and coupled to the central section, the second annular flexion member facilitating movement between the second outer section and the central section.

3. The heat shield of claim 2, further comprising:

a second annular insert positioned within the second outer section second end of the second outer section, the second annular insert comprising a second slot, the second slot aligned with the first slot in the first annular insert;

a second pipe partially received within the second slot in the second annular insert, the second pipe aligned with the first pipe;

wherein the first rod is slidably received in the second pipe such that the first rod is partially contained in the first pipe and the second pipe simultaneously.

4. The heat shield of claim 3, wherein:

movement between the first outer section and the central section causes movement between the first pipe and the first rod and movement between the second pipe and the first rod; and movement between the second outer section and the central causes movement between the first pipe and the first rod and movement between the second pipe and the first rod.

5. The heat shield of claim 2, wherein the second outer section is identical to the first outer section.

6. The heat shield of claim 1, further comprising:

a second pipe having a third length; and a second rod slidably received within the second pipe, the second rod having a fourth length greater than the third length;

wherein the first annular insert comprises a second slot;

wherein the second pipe is partially received within the second slot in the first annular insert; and wherein movement between the first outer section and the central section causes movement between the second pipe and the second rod.

7. The heat shield of claim 6, wherein movement between the first pipe and the first rod occurs simultaneously with movement between the second pipe and the second rod.

8. The heat shield of claim 6, wherein the first pipe is parallel to the second pipe such that the first rod is parallel to the second rod.

9. An exhaust system comprising:

a first component;

a second component that receives exhaust gasses from the first component;

a bellows coupled to the first component and the second component and that provides fluid communication between the first component and the second component, the bellows configured to facilitate relative movement between the first component and the second component; and a heat shield coupled to the first component and the second component, the heat shield configured to cover the bellows, the heat shield comprising:

a first outer section coupled to the first component;

a second outer section coupled to the second component;

a central section;

a first annular flexion member coupled to the central section and the first outer section; and a second annular flexion member coupled to the central section and the second outer section;

wherein movement between the first component and the second component causes corresponding movement of the bellows and the heat shield such that the bellows remains covered by the heat shield during the movement; and wherein the first annular flexion member facilitates movement between the first outer section and the central section independent of the second annular flexion member and the second outer section.

10. The exhaust system of claim 9, wherein:

the bellows comprises a flexible member; and the heat shield is isolated from contact with the flexible member.

11. The exhaust system of claim 9, wherein the second annular flexion member facilitates movement between the second outer section and the central section independent of the first annular flexion member and the first outer section.

12. The exhaust system of claim 9, further comprising:

a first annular insert positioned within the first outer section, the first annular insert comprising a first slot; and a second annular insert positioned within the second outer section, the second annular insert comprising a second slot.

13. The exhaust system of claim 12, further comprising:

a first pipe partially received within the first slot in the first annular insert;

a second pipe partially received within the second slot in the second annular insert;

a rod slidably received within the first pipe and the second pipe;

wherein movement between the first outer section and the central section and/or movement between the second outer section and the central section causes movement between the first pipe and the rod and/or movement between the second pipe and the rod.

14. The exhaust system of claim 12, further comprising:
a first connector coupled to the first outer section;
a second connector coupled to the second outer section;
a coupler slidably coupled to both the first connector and the second connector;
wherein movement between the first outer section and the central section and/or movement between the second outer section and the central section causes movement between the first connector and the coupler and/or movement between the second connector and the coupler.

15. The exhaust system of claim 14, wherein:
the first connector comprises a first slot;
the second connector comprises a second slot; and
the coupler comprises:
a first protrusion slidably coupled to the first connector within the first slot; and
a second protrusion slidably coupled to the second connector within the second slot.

16. A heat shield for a bellows, the heat shield comprising:
a central section;
a first outer section coupled to a first fixture;
a first annular flexion member coupled to the central section and the first outer section, the first annular flexion member configured to facilitate movement of the first outer section relative to the central section; and
a first means for facilitating axial translation of the central section relative to the first fixture such that axial translation of the central section causes movement of the first outer section relative to the first fixture.

17. The heat shield of claim 16, further comprising:
a second outer section coupled to a second fixture;
a second annular flexion member coupled to the central section and the second outer section, the second annular flexion member configured to facilitate movement of the second outer section relative to the central section; and
a second means for facilitating axial translation of the central section relative to the second fixture such that axial translation of the central section causes movement of the second outer section relative to the second fixture.

18. The heat shield of claim 17, wherein:
the second outer section is identical to the first outer section;
the second annular flexion member is identical to the first annular flexion member; and
the second means is identical to the first means.

19. The heat shield of claim 16, wherein:
the bellows comprises a flexible member; and
the first outer section, the first annular flexion member, and the first means are isolated from contact with the flexible member.

20. The heat shield of claim 16, further comprising a second means for facilitating axial translation of the central section relative to the first fixture in conjunction with the first means.

21. An exhaust system comprising:
a first component;
a second component that receives exhaust gasses from the first component;
a bellows coupled to the first component and the second component and that provides fluid communication between the first component and the second component, the bellows configured to facilitate relative movement between the first component and the second component;
a heat shield coupled to the first component and the second component, the heat shield configured to cover the bellows, the heat shield comprising:
a first outer section coupled to the first component;
a second outer section coupled to the second component;
a central section;
a first annular flexion member coupled to the central section and the first outer section; and
a second annular flexion member coupled to the central section and the second outer section;
a first annular insert positioned within the first outer section, the first annular insert comprising a first slot; and
a second annular insert positioned within the second outer section, the second annular insert comprising a second slot;
wherein movement between the first component and the second component causes corresponding movement of the bellows and the heat shield such that the bellows remains covered by the heat shield during the movement.

22. The exhaust system of claim 21, further comprising:
a first pipe partially received within the first slot in the first annular insert;
a second pipe partially received within the second slot in the second annular insert;
a rod slidably received within the first pipe and the second pipe;
wherein movement between the first outer section and the central section and/or movement between the second outer section and the central section causes movement between the first pipe and the rod and/or movement between the second pipe and the rod.

23. The exhaust system of claim 21, further comprising:
a first connector coupled to the first outer section;
a second connector coupled to the second outer section;
a coupler slidably coupled to both the first connector and the second connector;
wherein movement between the first outer section and the central section and/or movement between the second outer section and the central section causes movement between the first connector and the coupler and/or movement between the second connector and the coupler.

24. The exhaust system of claim 23, wherein:
the first connector comprises a first slot;
the second connector comprises a second slot; and
the coupler comprises:
a first protrusion slidably coupled to the first connector within the first slot; and
a second protrusion slidably coupled to the second connector within the second slot.

* * * * *